US012704313B2

(12) United States Patent
Cho et al.

(10) Patent No.: US 12,704,313 B2
(45) Date of Patent: Aug. 11, 2026

(54) HOME APPLIANCE

(71) Applicant: LG Electronics Inc., Seoul (KR)

(72) Inventors: Yonghyun Cho, Seoul (KR); Sanghyun Cheon, Seoul (KR)

(73) Assignee: LG Electronics Inc., Seoul (KR)

( * ) Notice: Subject to any disclaimer, the term of this patent is extended or adjusted under 35 U.S.C. 154(b) by 160 days.

(21) Appl. No.: 18/710,684

(22) PCT Filed: Nov. 16, 2022

(86) PCT No.: PCT/KR2022/018075

§ 371 (c)(1),
(2) Date: May 16, 2024

(87) PCT Pub. No.: WO2023/090845

PCT Pub. Date: May 25, 2023

(65) Prior Publication Data

US 2025/0035367 A1 Jan. 30, 2025

(30) Foreign Application Priority Data

Nov. 16, 2021 (KR) ..... 10-2021-0157933

(51) Int. Cl.
*F25D 23/02* (2006.01)
*F25D 27/00* (2006.01)

(52) U.S. Cl.
CPC ..... *F25D 23/028* (2013.01); *F25D 27/00* (2013.01)

(58) Field of Classification Search
None
See application file for complete search history.

(56) References Cited

U.S. PATENT DOCUMENTS

| | | | | |
|---|---|---|---|---|
| 8,789,900 | B2 | 7/2014 | Laible et al. | |
| 9,516,956 | B2 * | 12/2016 | Lee | F25D 23/04 |
| 10,119,751 | B2 * | 11/2018 | Choi | H05B 47/115 |
| 10,465,978 | B2 | 11/2019 | Seo et al. | |
| 10,524,586 | B2 * | 1/2020 | Oh | A47F 3/0434 |

(Continued)

FOREIGN PATENT DOCUMENTS

| | | | | |
|---|---|---|---|---|
| AU | 2020396667 B2 * | 4/2024 | ..... | F25D 29/005 |
| CN | 112797719 | 5/2021 | | |

(Continued)

OTHER PUBLICATIONS

International Search Report and Written Opinion in International Appln. No. PCT/KR2022/018075, mailed on Feb. 22, 2023, 9 pages (with partial English translation).

(Continued)

*Primary Examiner* — Hanh V Tran
(74) *Attorney, Agent, or Firm* — Fish & Richardson P.C.

(57) ABSTRACT

A home appliance according to an embodiment of the present invention comprises: a cabinet having a storage space formed therein; and a door opening/closing the storage space, wherein the door comprises: a door body having an opening penetrating therethrough in the back and forth direction; and a panel assembly which is attached to the door body to shield the opening, and forms the front surface of the door, and the panel assembly is formed to transmit light so that the front surface of the door is expressed in a set color and the storage space is projected through the opening.

12 Claims, 33 Drawing Sheets

(56) References Cited

U.S. PATENT DOCUMENTS

| | | | | |
|---|---|---|---|---|
| 10,677,515 | B2 * | 6/2020 | Choi | F25D 23/028 |
| 10,808,994 | B2 * | 10/2020 | Lee | G02B 6/0093 |
| 11,885,556 | B2 * | 1/2024 | Kang | F25D 27/005 |
| 11,959,691 | B2 * | 4/2024 | Kwon | F25D 23/02 |
| 11,988,442 | B2 * | 5/2024 | Kwon | F25D 23/066 |
| 12,235,035 | B2 * | 2/2025 | Song | F25D 27/00 |
| 12,235,036 | B2 * | 2/2025 | Park | F25D 23/028 |
| 12,253,297 | B2 * | 3/2025 | Song | F24C 15/04 |
| 12,405,049 | B2 * | 9/2025 | Woo | F25D 23/025 |
| 12,442,585 | B2 * | 10/2025 | Song | A47F 3/001 |
| 2020/0248959 | A1 | 8/2020 | Kang et al. | |
| 2021/0254888 | A1 | 8/2021 | Cremaschi | |

FOREIGN PATENT DOCUMENTS

| | | | | |
|---|---|---|---|---|
| CN | 112797719 A * | 5/2021 | | F25D 29/00 |
| KR | 10-2019-0135396 | 12/2019 | | |
| KR | 10-2020-0038222 | 4/2020 | | |
| KR | 10-2259753 | 6/2021 | | |
| WO | WO-2020096258 A1 * | 5/2020 | | D06F 39/14 |
| WO | WO 2021/212934 | 10/2021 | | |

OTHER PUBLICATIONS

Extended European Search Report in European Appln. No. 22896050.6, mailed on Sep. 19, 2025, 7 pages.

* cited by examiner

HOME APPLIANCE

CROSS-REFERENCE TO RELATED APPLICATIONS

This application is a National Stage application under 35 U.S.C. § 371 of International Application No. PCT/KR2022/018075, filed on Nov. 16, 2022, which claims the benefit of Korean Patent Application No. 10-2021-0157933, filed on Nov. 16, 2021. The disclosures of the prior applications are incorporated by reference in their entirety.

TECHNICAL FIELD

The present disclosure relates to a home appliance.

BACKGROUND ART

Generally, home appliances are placed indoors and may be disposed to harmonize with the surrounding space. In addition, in order to further improve the outer appearance of such home appliances, a panel that forms the outer appearance may be provided on the front surface of the home appliance.

Typically, in the refrigerator, structures are being developed to vary the outer appearance of the front surface of refrigerators in order to harmonize with the environment in which they are placed, surrounding furniture, or other home appliances, and this trend is taking place across home appliances.

In addition, structures that vary the outer appearance of the front surface of the refrigerator door are being developed to harmonize with the environment in which the refrigerator is placed or with surrounding furniture or home appliances, and this trend is taking place across home appliances.

In U.S. Pat. No. 8,789,900, a structure is disclosed in which a decoration panel that forms the outer appearance of the front surface of the door of a refrigerator is mounted, and the decoration panel is configured to be detachable so that an outer appearance of the front surface of the door that suits the user's preference may be created.

In this structure, there is a problem that it is impossible to check the contents placed inside unless the user opens the door. In addition, structurally, it is impossible to see through the inside of the door.

In addition, in Korean Patent No. 102259753, a refrigerator structure is disclosed in which the refrigerator door is equipped with a transparent panel assembly that can see through the space behind the door.

This structure has the advantage of being able to check the food stored in the refrigerator without opening the door, but there is a problem in that a replaceable panel cannot be attached to the outside of the door and therefore it is impossible to change the outer appearance of the front surface of the door to suit the user's preference.

DISCLOSURE

Technical Problem

An object of an embodiment of the present disclosure is to provide a home appliance that allows the rear of the door to be seen through the seeing-through area of the door, and at the same time, the color of the front surface of the door may be changed.

An object of an embodiment of the present disclosure is to provide a home appliance on which a panel assembly is mounted on the front surface of a door to form the outer appearance of the front surface of the door in a selected color by irradiating light according to the user's selection and which may be seen through while the panel assembly is mounted.

An object of an embodiment of the present disclosure is to provide a home appliance in which a panel assembly forming the outer appearance of the front surface of the door is detachably mounted on the front surface of the door and which may see through the space behind the door while the panel assembly is mounted.

Technical Solution

A home appliance according to an embodiment of the present disclosure includes a cabinet forming a storage space and a door configured to open and close the storage space, the door may include a door body having an opening passing through in the front and rear direction; and a panel assembly mounted on the door body to cover the opening and forming a front surface of the door, and the panel assembly may be configured to transmit light, the front surface of the door may be expressed in a set color, and the storage space may be seen through the opening.

The panel assembly may include a panel forming the front surface of the panel assembly and made of a material that transmits light; and a lighting device provided behind the panel and emitting light to make the panel glow with a set color.

The panel assembly may include a back cover forming a rear of the panel assembly, and a cover opening may be formed in the back cover to at least partially overlap the opening.

The panel assembly may include a light guide plate provided at the rear of the panel to guide light emitted from the lighting device to the panel, a pattern for diffusion of light may be formed on the light guide plate, the pattern may include a first pattern part configured to at least partially overlap the opening and to be capable of seeing through; and a second pattern part formed along the perimeter of the first pattern part, and the transparency of the first pattern part may be higher than the transparency of the second pattern part.

A reflective layer may be provided on the rear of the light guide plate to reflect light guided along the light guide plate forward, the reflective layer may include a first region formed to at least partially overlap the opening and capable of seeing through; and a second region formed along the perimeter of the first region and formed to be more opaque than the first region to reflect more light forward.

A color layer representing the color of the panel may be formed on the panel when the lighting device is turned off, the color layer may include a first color part at least partially overlapping the opening; and a second color part formed around the first color part, and the saturation of the first color part may be higher than the saturation of the second color part.

The door body may include a door liner forming the rear of the door body; a front plate forming the front surface of the door body; and a seeing-through assembly disposed between the door liner and the front plate to cover the opening, and made of a seeing-through material.

The opening may be formed in the door liner, and the front plate may be made of a seeing-through plate-shaped material to cover the front surface of the seeing-through assembly.

The front plate may include a seeing-through part formed to be capable of seeing through at a position corresponding to the seeing-through assembly; and a bezel part formed along an outer perimeter of the seeing-through portion and formed opaquely.

The seeing-through assembly may include a plurality of plates sized to cover the opening and spaced forward and backward, and a spacer formed along the perimeter of the plurality of plates to connect the plurality of plates to each other.

The door body may include an insulating material filled between the door liner, the front plate, and the perimeter of the seeing-through assembly, and the panel assembly may be detachably mounted on a door body filled with the insulating material.

A seeing-through light may be provided at the rear of the seeing-through assembly, when the see-through light is turned on, the space behind the see-through assembly may become bright and may be visible through the panel and the see-through assembly, and when the see-through light is turned off, the rear space may become dark and become more invisible.

The seeing-through light may be provided on the rear of the door body and irradiate light from the outside of the see-through assembly toward the see-through assembly.

The lighting device may be turned off when the seeing-through light is turned on.

The home appliance may further include a main door configured to open and close the storage space and having an opening communicating with the storage space, in which the door may be rotatably mounted on the main door to open and close the opening, and the inside of the opening may be seen through via the panel assembly.

Advantageous Effect

The following effects can be expected from the home appliance according to the proposed embodiment.

The color of the light emitted from the lighting device may be adjusted by user manipulation, and thus the color of the panel forming the front surface of the door may be changed to the selected color. Therefore, there is an advantage in that the front color of the door can be changed to a desired color without replacing the panel.

In particular, there is an advantage in increasing convenience of use by allowing the user to quickly and easily change the color of the outer appearance to a desired color at any time while the panel is mounted.

In addition, the status of the refrigerator or home appliance, operation information, information about the surrounding environment, or the like are displayed by changing the color of the panel, allowing the user to intuitively recognize the information, which has the advantage of further improving convenience of use.

In addition, the door is provided with a seeing-through assembly, and there is an advantage in that the rear space of the door can be selectively viewed through the seeing-through assembly from the outside of the door via the panel assembly.

In other words, when the user desires, the panel assembly and the seeing-through assembly are in a seeing-through state to make the space behind the door visible, and in other cases, the panel is made to glow in a selected color by the operation of the lighting device to form an outer appearance.

Accordingly, the door may operate three states, that is, a state where the lighting device is turned off and the outer appearance is formed in the color of the panel, a state where the lighting device is turned on and the outer appearance is formed in a different color, and a state where the see-through light is turned on and the rear of the door is visible, and the user's convenience may be increased by allowing it to be in one of the three states whenever the user wants.

At least a portion of the panel, the light guide plate, and the back plate constituting the panel assembly has a structure capable of seeing through the rear, and in particular, the back plate has an open portion overlapping with the seeing-through assembly, and thus there is an advantage in that, even when the panel assembly is mounted, the space behind the door may be seen from the front of the door.

The front surface of the door body may be composed of a front plate made of seeing-through glass or plastic. Accordingly, a separation structure between the door body filled with the insulation material and the panel assembly is possible, and it is also possible to see through the rear of the door through the seeing-through assembly.

Additionally, the panel is detachable from the door body, so if the user wants, there is an advantage that the panel may be easily replaced with a panel assembly with a different basic color in a state where the lighting device is turned off.

In addition, even when maintenance of the panel assembly or the door body is required, there is an advantage that the entire door does not need to be disassembled and the work may be done through simple separation of the panel assembly or the door body.

DESCRIPTION OF DRAWINGS

FIG. 28 is a front view illustrating the outer appearance of the front surface of the refrigerator with the lighting device turned on.

FIG. 29 is a front view illustrating the outer appearance of the front surface of the refrigerator with the seeing-through light turned on.

FIG. 33 is a front view illustrating the outer appearance of the front surface of the refrigerator when the lighting device of the refrigerator is turned on.

BEST MODE

Hereinafter, specific embodiments of the present disclosure will be described in detail along with the drawings. However, the present disclosure cannot be said to be limited to the embodiments in which the idea of the present disclosure is presented, and other disclosures that are regressive or other embodiments included within the scope of the present disclosure can be easily suggested by adding, changing, or deleting other components.

Before explaining, the direction is defined. In an embodiment of the present disclosure, based on the cabinet illustrated in FIG. 2, the direction toward the door may be referred to as a front direction, the direction toward the cabinet relative to the door may be referred to as a rear direction, the direction toward the floor where the refrigerator is installed may be referred to as a lower direction, and the direction away from the floor may be referred to as an upper direction.

Figure 1:
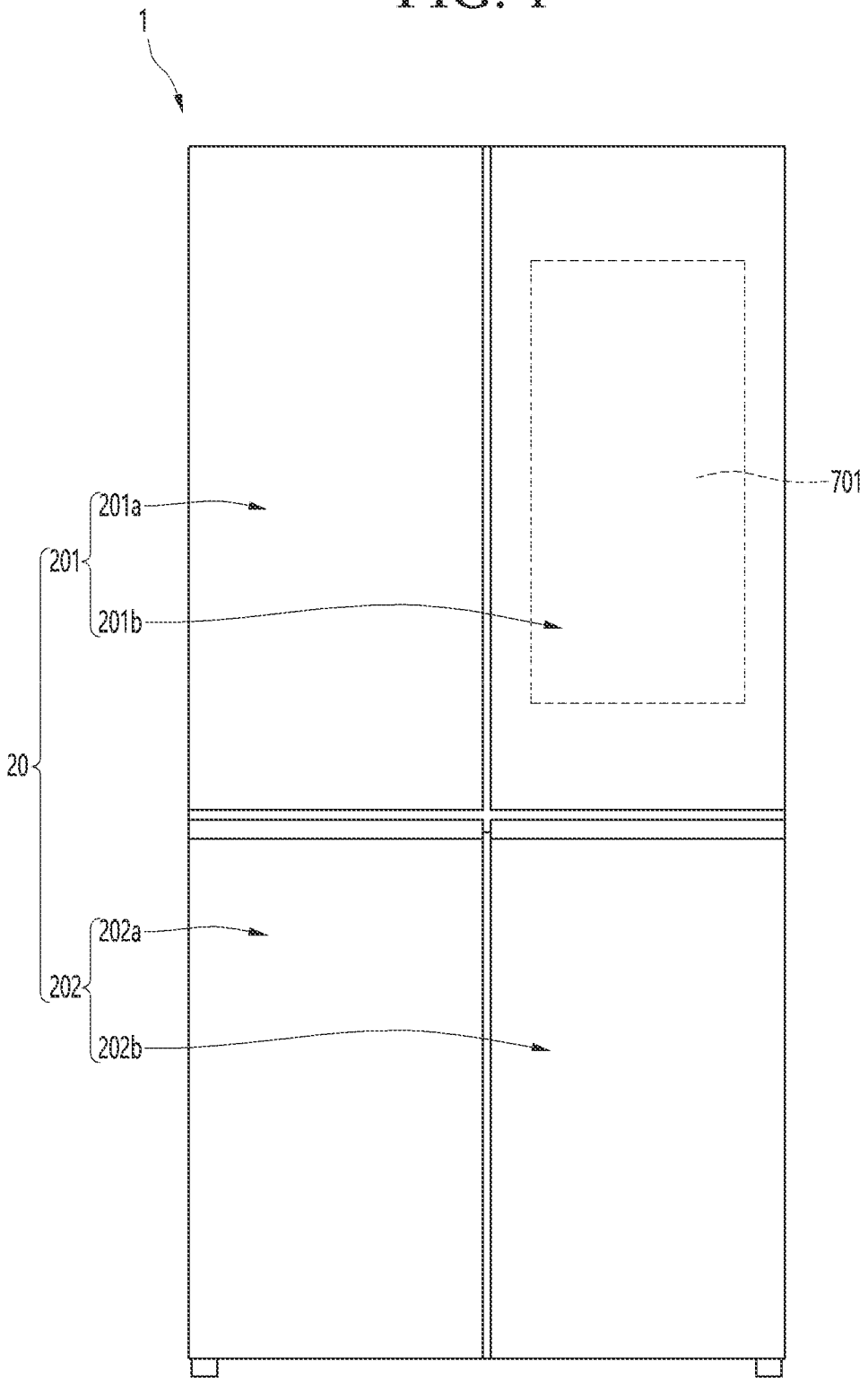
FIG. 1 is a front view illustrating a refrigerator according to an embodiment of the present disclosure.
Figure 2:
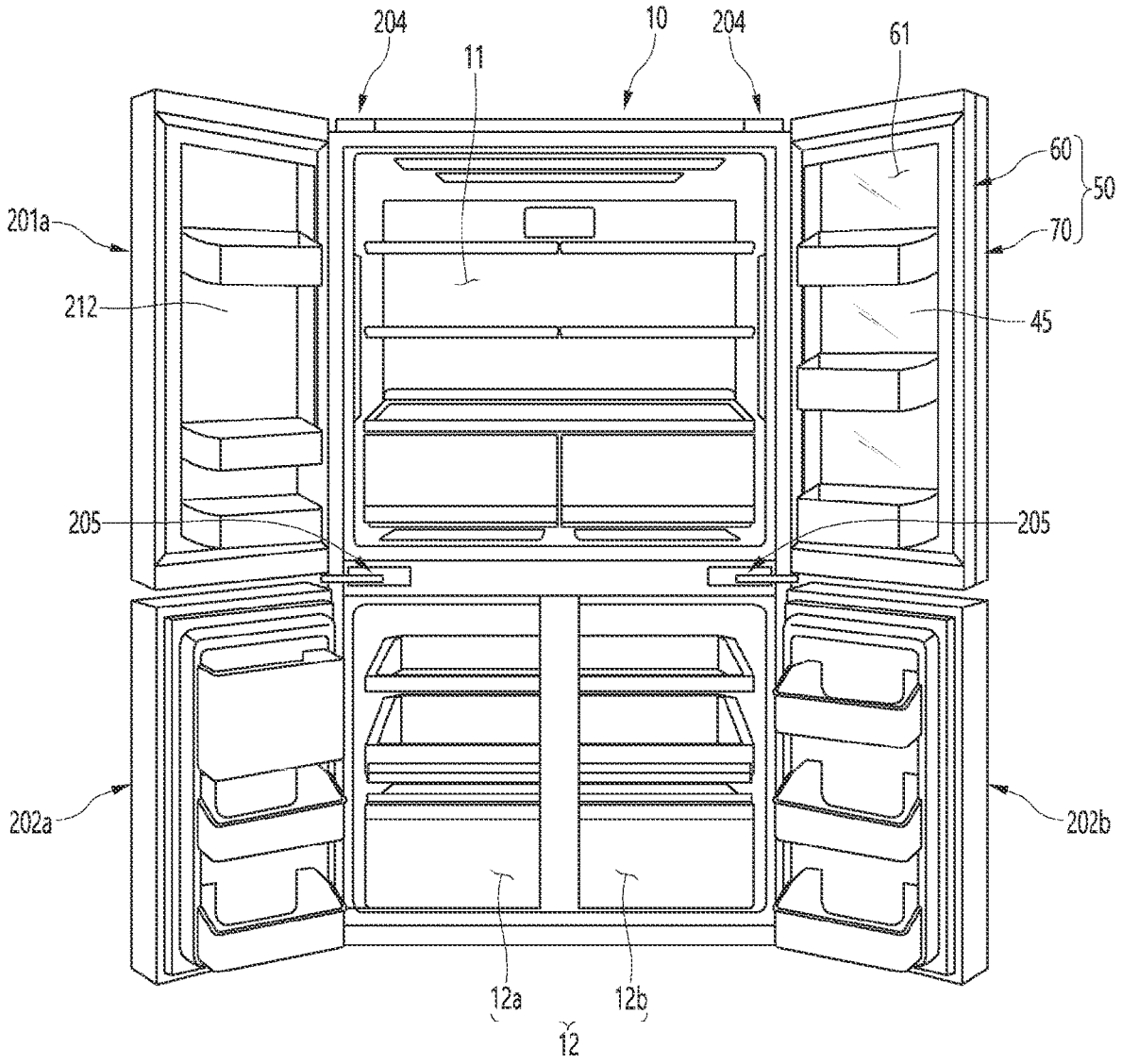
FIG. 2 is a front view illustrating a state where the door of the refrigerator is open.
Figure 3:
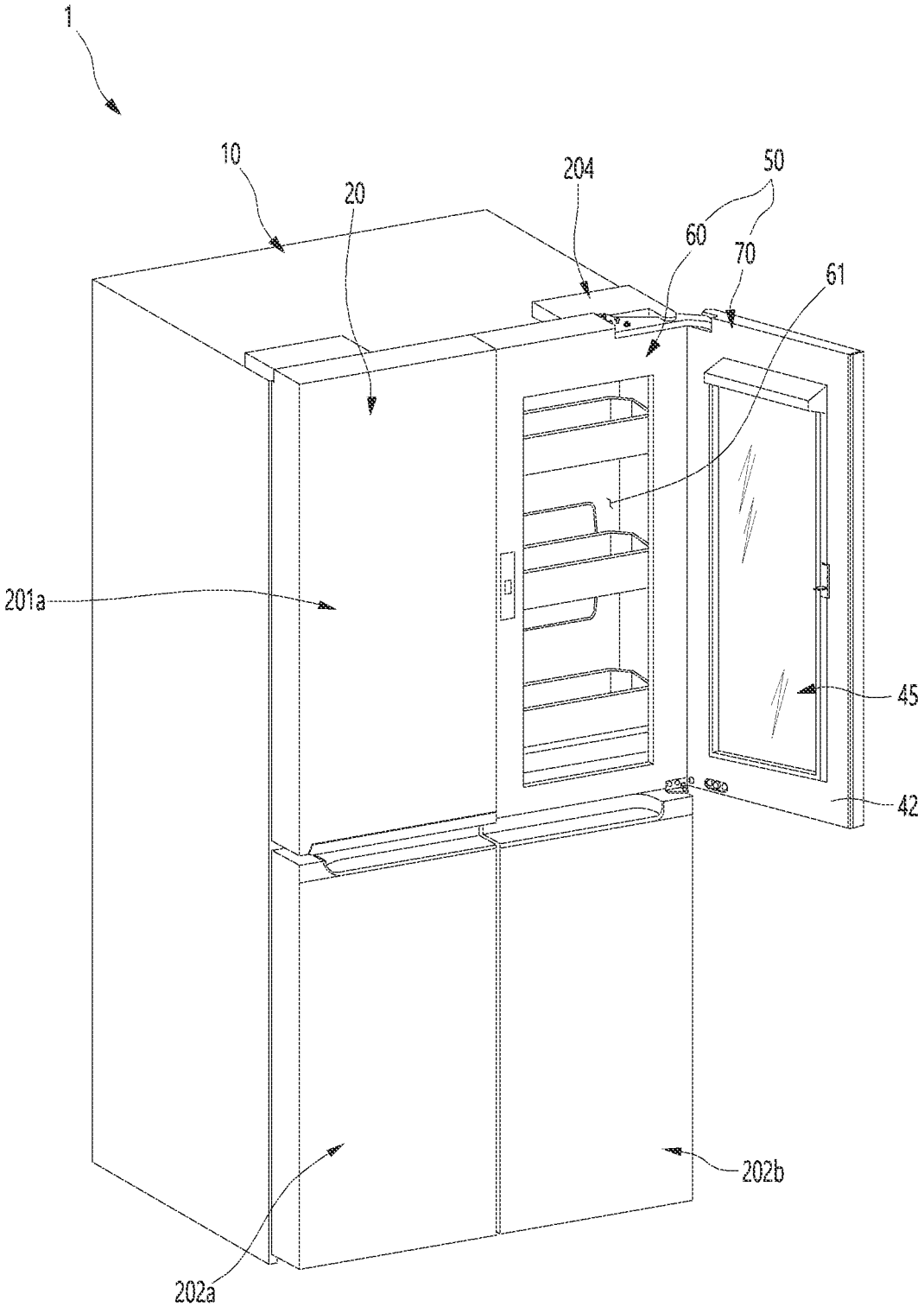
FIG. 3 is a front view illustrating a state where only a sub door of the doors of the refrigerator is open.

FIG. 1 is a front view illustrating a refrigerator according to an embodiment of the present disclosure, FIG. 2 is a front view illustrating a state where the door of the refrigerator is open, and FIG. 3 is a front view illustrating a state where only a sub door of the doors of the refrigerator is open.

As illustrated, the outer appearance of the refrigerator 1 according to an embodiment of the present disclosure may be formed by a cabinet 10 forming a storage space and a door 20 opening and closing the storage space of the cabinet 10.

For example, the cabinet 10 may form a storage space divided into upper and lower sections, and a refrigerating chamber 11 may be formed at the upper portion and a freezing chamber 12 may be formed at the lower portion. The refrigerating chamber may be referred to as an upper storage space, and the freezing chamber may be referred to as a lower storage space. Additionally, the freezing chamber 12 may be divided into both left and right sides to form a left freezing chamber 12*a* and a right freezing chamber 12*b*, respectively. The left freezing chamber 12*a* may be referred to as a left lower storage space, and the right freezing chamber 12*b* may be referred to as a right lower storage space.

The door 20 may be configured to open and close the refrigerating chamber 11 and the freezing chamber 12, respectively. For example, the door 20 may be rotatably mounted on the cabinet 10, and the refrigerating chamber 11 and the freezing chamber 12 may be opened and closed by rotation. Of course, the door 20 may have a structure that opens and closes by pulling in and out.

The door 20 may include a refrigerating chamber door 201 that opens and closes the refrigerating chamber 11 and a freezing chamber door 202 that opens and closes the freezing chamber. The refrigerating chamber door 201 may be referred to as an upper door and the freezing chamber door 202 may be referred to as a lower door.

Additionally, the refrigerating chamber door 201 may be disposed in a pair of a left refrigerating chamber door 201*a* and a right refrigerating chamber door 50 side by side. The left refrigerating chamber door 201*a* and the right refrigerating chamber door 50 may be disposed adjacent to each other and may be formed to have the same size. In addition, the left refrigerating chamber door 201*a* and the right refrigerating chamber door 50 may be rotated independently to open and close the refrigerating chamber 11.

The upper end and lower end of the refrigerating chamber door 201*a* and the freezing chamber door 201*b* may be coupled to the cabinet 10 by hinge devices 204 and 205, respectively. The hinge device 204 may be composed of an upper hinge 204 and a lower hinge 205, and allows the refrigerating chamber door 201*a* and the freezing chamber door 201*b* to be rotatably mounted.

Additionally, a pair of the freezing chamber doors 202, that is, a left freezing chamber door 202*a* and a right freezing chamber door 202*b* may be disposed side by side. Additionally, the left freezing chamber door 202*a* and the right freezing chamber door 202*b* may be rotated independently to open and close the freezing chamber. The left freezing chamber door 202*a* and the right freezing chamber door 202*b* may be placed adjacent to each other and may be formed to have the same size.

Of course, in this embodiment, for convenience of explanation and understanding, a refrigerator with a structure in which the refrigerating chamber 11 is disposed at the upper portion and the freezing chamber 12 is disposed at the lower portion is described as an example, but the present disclosure is limited to the shape of the refrigerator and may be applied to all types of refrigerators equipped with doors.

Meanwhile, the door 20 forms the outer appearance of the front surface of the refrigerator 1 in a state of being closed and may form the outer appearance of the refrigerator 1 seen from the front in a state where the refrigerator 1 is installed.

The door 20 may have a structure that allows the front surface to selectively emit light, and may be configured to glow with a set color or brightness. Accordingly, the user can change the front color or brightness of the door 20 without removing or disassembling the door 20 and change the overall outer appearance of the refrigerator 1.

Hereinafter, the structure of the door 20 will be examined in detail with reference to the drawings.

In an embodiment of the present disclosure, the left refrigerating chamber door 201*a* and the freezing chamber door 202 have the same overall structure except for their positions and sizes, and these doors 201*a* and 202 may be referred to as panel doors or first doors.

In addition, the right refrigerating chamber door 50 has a different structure from the doors 201*a* and 202 and may have a structure capable of seeing through the rear space, that is, the space in the refrigerator. Therefore, the right refrigerating chamber door 50 may be referred to as a seeing-through door or a second door. Hereinafter, the description will focus on the right refrigerating chamber door 50.

In addition, in the embodiment of the present disclosure, it is explained as an example that one seeing-through door is provided, but multiple seeing-through doors may be provided. Additionally, the seeing-through door may be formed in a location other than the right refrigerating chamber door 50.

The right refrigerating chamber door 50 may include a main door 60 and a sub door 70. The main door 60 is rotatably mounted on the cabinet 10 and may be configured to open and close the refrigerating chamber 11 by rotation. Additionally, an opening 61 penetrating the main door 60 may be formed in the main door 60. The opening 61 may be formed to penetrate the remaining portion excluding the perimeter of the main door 60, and at least a portion thereof may form a portion of the internal storage space.

Additionally, the sub door 70 may be mounted on the main door 60. The sub door 70 is rotatably mounted on the main door 60 and may open and close the opening 61. At this time, the sub door 70 may be formed to be the same size as the main door 60, and the outer appearance of the front surface of the right refrigerating chamber door 50 may be formed by the sub door 70 when viewed from the front.

In other words, the sub door 70 may form the outer appearance of the front surface of the right refrigerating chamber door 50 and may be displayed in the same color as the doors 201*a* and 202 according to the operation of the lighting device 36. In addition, the sub door 70 may visualize the inside of the opening 61 or the space in the refrigerator according to the user's manipulation. For this purpose, a seeing-through region 701 may be formed in the sub door 70. The seeing-through region 701 may appear selectively, and when the seeing-through region 701 does not appear, it may be displayed in a set color to form the outer appearance of the front surface of the sub door 70. The seeing-through region 701 may be referred variously to as a visualization part, a seeing-through window, or a window.

Hereinafter, the structure of the sub-door 70 will be looked at in more detail, and unless otherwise specified, the sub-door 70 will be referred to as a door 70.

Figure 4:
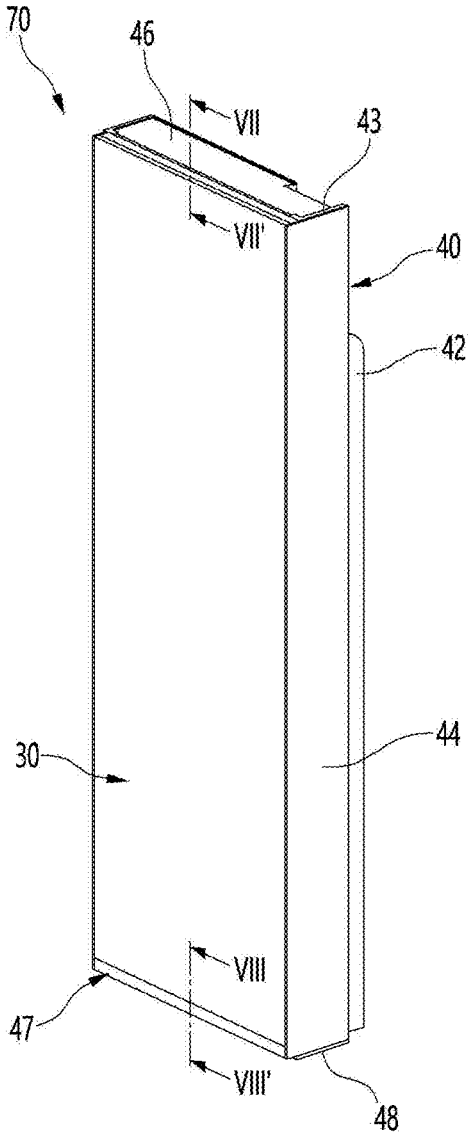
FIG. 4 is a perspective view illustrating the door.
Figure 5:
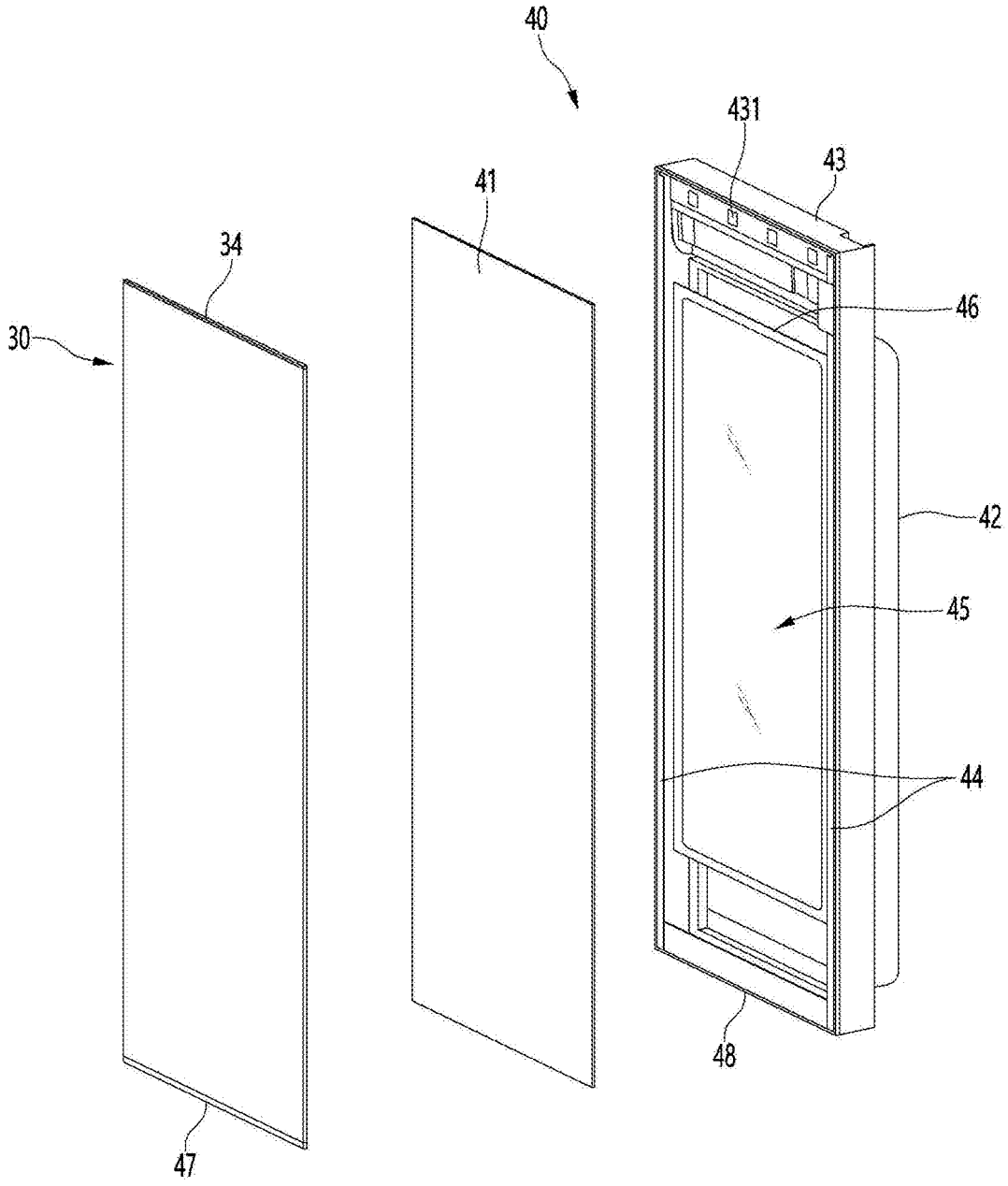
FIG. 5 is an exploded perspective view illustrating a state where the panel assembly constituting the door and the door body are separated.

FIG. 4 is a perspective view illustrating the door, and FIG. 5 is an exploded perspective view illustrating a state where the panel assembly constituting the door and the door body are separated.

As illustrated, the door 70 may include a door body 40 that forms the overall shape of the door 70, and a panel assembly 30 that forms the outer appearance of the front surface of the door 70. In other words, the door 70 may be configured so that the panel assembly 30 is mounted on the front surface of the door body 40.

The door body 40 may be provided with an insulation material 400 therein and a seeing-through assembly 45 capable of seeing the space behind the door 70. Additionally, the front surface of the door body 40 may have a structure through which the seeing-through assembly 45 may be seen.

Additionally, the panel assembly 30 may be mounted on the door body 40 to form the front surface of the door 70. The panel assembly 30 may be detachably mounted, and the panel assembly 30 may be replaced, separated, or mounted as needed.

Although not illustrated in detail, upper protrusions 343 (see FIG. 14) and lower protrusions 473 (see FIG. 23) are formed at the upper end and the lower end of the rear of the panel assembly 30, and the upper protrusion 343 and the lower protrusion 473 may be mounted on the upper mounting part 431 formed on the upper end of the front surface of the door body 40 and the lower mounting part formed on the lower end thereof so that the panel assembly 30 is fixed.

The panel assembly 30 covers the entire front surface of the door body 40 when installed, forming the front surface of the door 70. Therefore, the color of the panel assembly 30 determines the front color of the door 70. Additionally, the color of the panel assembly 30 may change while mounted according to the user's selection.

Additionally, at least a portion of the panel assembly 30 may be transparent, and the seeing-through assembly 45 may be visible to the outside. For example, the seeing-through region 701 may be formed at a position corresponding to the seeing-through assembly 45. Therefore, when the door 70 is closed, the space behind the door 70 may be seen through the seeing-through region 701.

To this end, a portion of the panel assembly 30, the front plate 41, and the seeing-through assembly 45 may be made transparent. At this time, the meaning of transparency refers to transparency to the extent that the rear space may be seen, including a completely transparent state and may be used with the same meaning throughout the specification.

Hereinafter, the structure of the door body 40 will be examined in detail with reference to the drawings.

Figure 6:
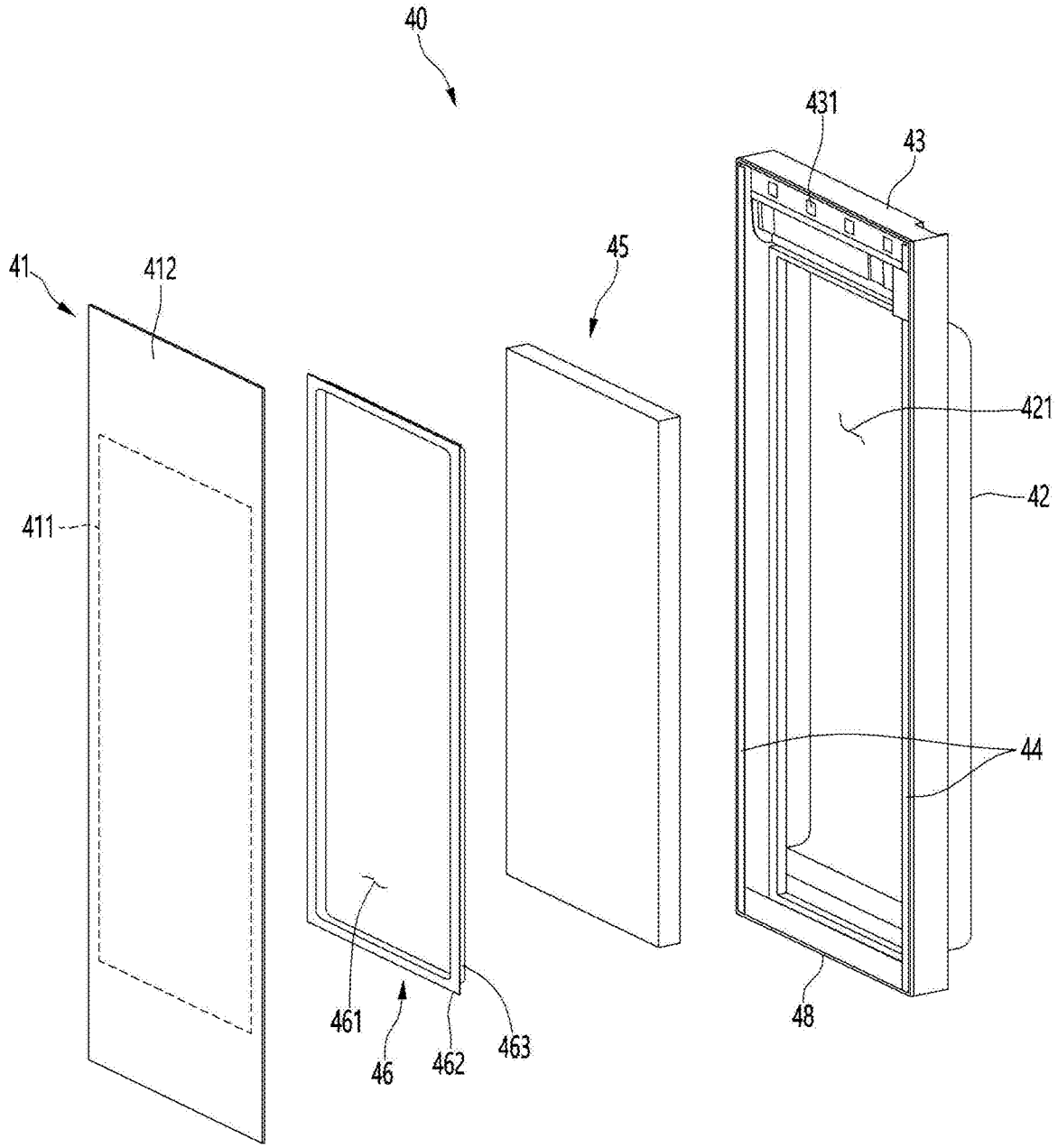
FIG. 6 is an exploded perspective view illustrating the door body.
Figure 7:
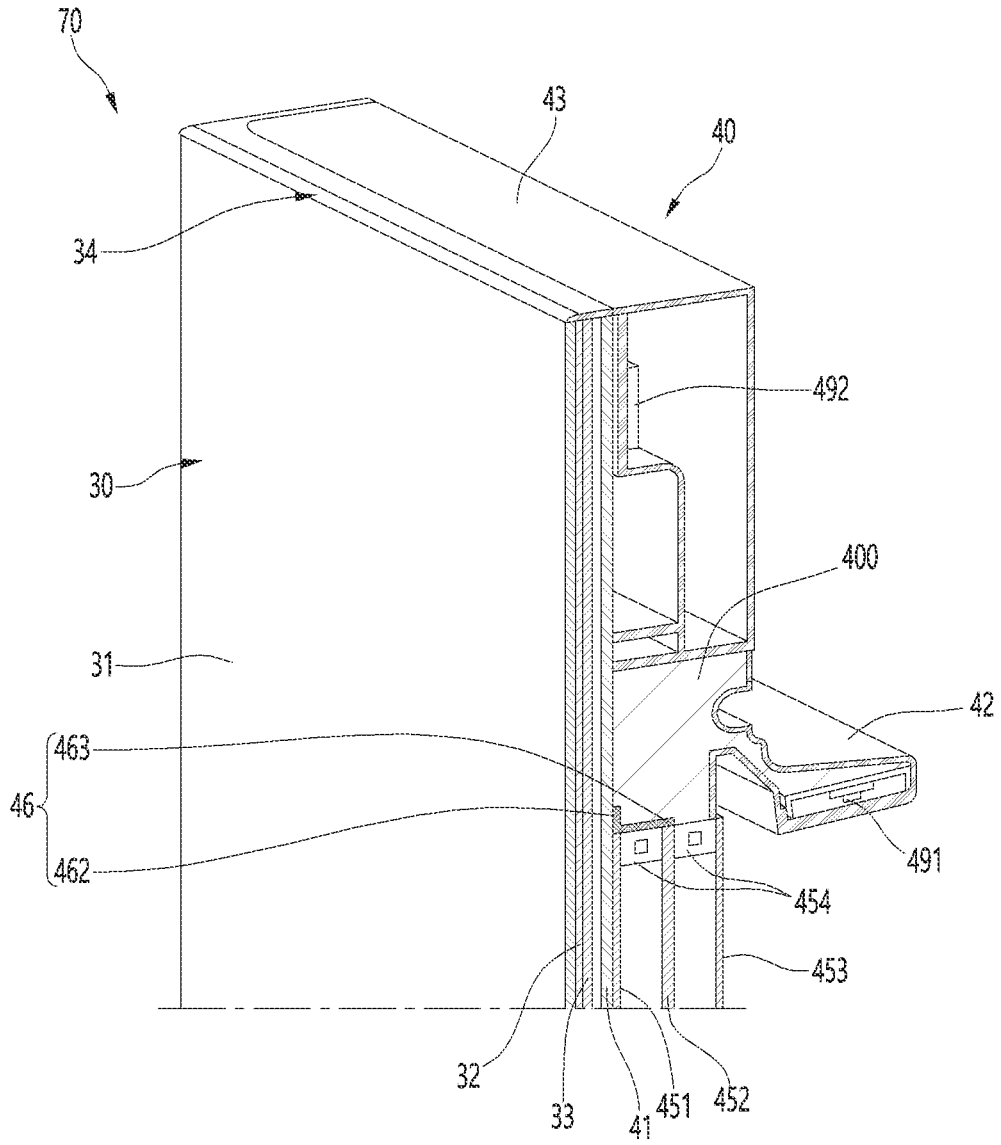
FIG. 7 is a perspective view taken along line VII-VII' of FIG. 4.
Figure 8:
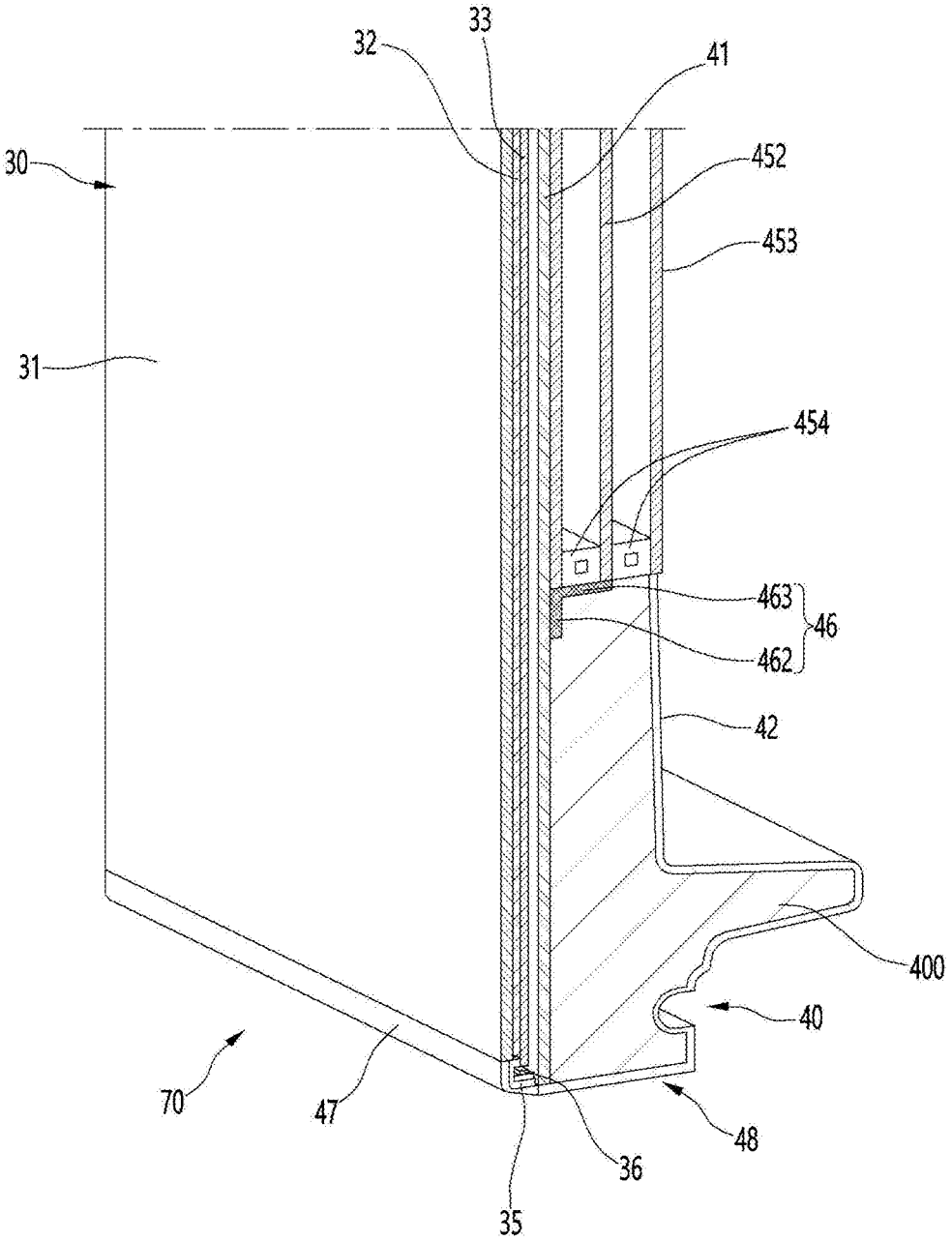
FIG. 8 is a perspective view taken along line VIII-VIII' of FIG. 4.

FIG. 6 is an exploded perspective view illustrating the door body, FIG. 7 is a perspective view taken along line VII-VII' of FIG. 4, and FIG. 8 is a perspective view taken along line VIII-VIII' of FIG. 4.

As illustrated in the drawing, the door body 40 may include a seeing-through assembly 45, a front plate 41 forming the front surface and covering the seeing-through assembly 45, and a door liner 42 forming the rear.

At least a portion of the front plate 41 may be made of a seeing-through material and may be disposed to face the rear of the panel assembly 30. For example, the front plate 41 may be made of a material such as glass, acrylic, or plastic and may be formed in a plate shape corresponding to the front surface of the door body 40.

Additionally, the door liner 42 may be made of a plastic material and may form the shape of the rear of the door 70. Additionally, a liner opening 421 may be formed in the door liner 42. The liner opening 421 may be open so as to be covered by the seeing-through assembly 45. Accordingly, the rear space of the door 70 may be seen through the seeing-through assembly 45.

Additionally, the door liner 42 may be provided with a see-through light 491. The see-through light 491 is for selective visualization of the see-through assembly 45, and when turned on, brightens the rear region of the see-through assembly 45 so that the space behind the door 70 may be seen through the see-through assembly 45. In addition, when the see-through light 491 is turned off, the rear region of the see-through assembly 45 becomes dark and the space behind the door 70 is not visible through the see-through assembly 45. Additionally, since the see-through light 491 is provided on the door 70, it may also be referred to as a door light. Additionally, to distinguish the see-through light 491 from the lighting device 36, the lighting device 36 may be referred to as a first light, and the see-through light 491 may be referred to as a second light.

The see-through light 491 may be formed at a location adjacent to the rear of the see-through assembly 45. As an example, the see-through light 491 may be provided on a portion protruding from the upper end of the liner opening 421 and may be configured to radiate light downward. Accordingly, the rear of the seeing-through assembly 45 may be selectively illuminated, and selective visualization through the seeing-through assembly 45 is possible. Of course, the see-through light 491 may be placed in the opening of the main door 60 instead of the door, or may be provided on one side of inside of the refrigerator.

The seeing-through assembly 45 is configured to have a plurality of transparent plates 451, 452, and 453 spaced apart from each other, and may be disposed such that the front face faces the front plate 41 and the rear face faces the liner opening 421.

In detail, the seeing-through assembly 45 may include a first plate 451 forming a front surface and a second plate 452 forming a rear. The first plate 451 and the second plate 452 may be made of a transparent material, for example, a tempered glass material.

The first plate 451 may be disposed to face the front plate 41, or may be configured to be in contact with the rear of the front plate 41. Additionally, the second plate 452 may be formed in a size corresponding to the liner opening 421 to cover the liner opening 421.

The first plate 451 and the second plate 452 may be spaced apart from each other, and a spacer 454 is provided between the first plate 451 and the second plate 452 to form at least one airtight space or insulating space between the first plate 451 and the second plate 452.

In detail, a third plate 453 may be provided between the first plate 451 and the second plate 452. The third plate 453 may be formed of the same transparent material as the first plate 451 and the second plate 452. For example, the third plate 453 may be made of tempered glass or insulating glass.

Additionally, a first spacer 454*a* may be provided between the first plate 451 and the third plate 453. The first spacer 454*a* is formed along the perimeter of the first plate 451 and the third plate 453 and may be adhered to the rear of the first plate 451 and the front surface of the third plate 453 in an airtight state. Accordingly, an airtight space may be formed between the first plate 451 and the third plate 453, and argon gas may be injected into the airtight space or a vacuum state may be maintained to form an insulated space.

Additionally, a second spacer 454*b* may be provided between the third plate 453 and the second plate 452. The second spacer 454*b* is formed along the perimeter of the third plate 453 and the second plate 452, and may be adhered to the rear of the third plate 453 and the front surface of the second plate 452 in an airtight state. Accordingly, an airtight space may be formed between the third plate 453 and the second plate 452, and argon gas may be injected into the airtight space or a vacuum state may be maintained to form an insulated space.

Meanwhile, a mounting bracket 46 for mounting the seeing-through assembly 45 may be provided inside the door body 40. The mounting bracket 46 allows the seeing-through assembly 45 to maintain fixed inside the door body 40.

The mounting bracket 46 may be formed of the plastic material and may be formed along the perimeter of the outer surface of the seeing-through assembly 45. In other words, the mounting bracket 46 may be formed in a rectangular frame shape with a bracket opening 461 formed in the center, and the seeing-through assembly 45 may be mounted inside the bracket opening 461.

In detail, the mounting bracket 46 may include a first fixing part 462 for fixing to the front plate 41 and a second fixing part 463 for fixing the seeing-through assembly 45.

The first fixing part 462 may be formed along the perimeter of the bracket opening 461, may be formed parallel to the rear of the front plate 41, and may be adhered to the rear of the front plate 41.

Additionally, the second fixing part 463 is formed along the first fixing part 462 and may extend vertically backward from the inner end portion of the first fixing part 462. The inner surface of the bracket opening 461 that is in contact with the peripheral surface of the seeing-through assembly 45 may be formed by the second fixing part 463.

The second fixing part 463 may fix the outer end of the seeing-through assembly 45, and thus maintains the seeing-through assembly 45 mounted in the correct position inside the door body 40.

Meanwhile, the front plate 41 may form the front surface of the door body 40 and may be formed to be at least larger than the size of the mounting bracket 46. As an example, the upper end and the lower end of the front plate 41 are in contact with the upper cap decoration 43 and the lower cap decoration 48, and both left and right ends of the front plate 41 may be in contact with the side decoration 44.

Additionally, a seeing-through part 411 may be formed in a portion of the front plate 41 that overlaps the seeing-through assembly 45. The seeing-through part 411 may be transparent so that the seeing-through assembly 45 and the rear of the door 70 are visible through the seeing-through assembly 45. Additionally, the seeing-through part 411 may be formed to be the same size or slightly smaller than the seeing-through assembly 45.

Additionally, a bezel part 412 may be formed along the perimeter of the front plate 41. The bezel part 412 is formed from the outside of the seeing-through part 411 to the outer end of the front plate 41, and may be formed opaquely so that the inner structure of the door body 40 is not visible. For example, the bezel part 412 may be printed in black or may be formed by attaching a film.

Therefore, when the front plate 41 is mounted, other components, including the insulation material inside the door body 40, are not exposed, and only the seeing-through assembly 45 may be visible through the seeing-through part 411.

Meanwhile, the front plate 41 and the mounting bracket 46 may be omitted from the door body 40. In other words, the first plate 451 forming the front surface of the seeing-through assembly 45 may be formed to form the front surface of the door body 40 instead of the front plate 41. At this time, the size of the first plate 451 may be formed to be in contact with the upper cap decoration 43, the lower cap decoration 48, and a pair of side decoration 44. At this time, the size of the first plate 451 may be larger than the size of the second plate 452.

Meanwhile, the door body 40 may include side decorations 44 that form both left and right sides of the door body 21. The side decoration 44 may connect both left and right ends of the front plate 41 and both left and right ends of the door liner 42.

In addition, the door body 40 may include an upper cap decoration 43 and a lower cap decoration 48 that form the upper and lower surfaces of the door body 40. The upper cap decoration 43 may be connected to the upper end of the side decoration 44, the upper end of the front plate 41, and the upper end of the door liner 42. Additionally, the lower cap decoration 48 may be connected to the lower end of the side decoration 44, the lower end of the front plate 41, and the lower end of the door liner 42.

The outer appearance of the door body 40 may be formed by the front plate 41, door liner 42, side decoration 44, upper cap decoration 43, and lower cap decoration 48. In addition, the space between the inner surface of the door body 40 formed by combining the front plate 41, the door liner 42, the side decoration 44, the upper cap decoration 43, and the lower cap decoration 48 and the outer surface of the seeing-through assembly 45 may be filled with an insulating material.

Additionally, a sensing device 492 may be provided on one side of the upper cap decoration 43. The sensing device 492 detects the user's manipulation and can determine whether to turn on or off the see-through light 491 for selective visualization of the see-through assembly 45.

As an example, the detection device 492 may be configured as a knock detection sensor. The knock detection sensor is configured to detect when a user knocks on the front surface of the door 70, that is, the front surface of the panel assembly 30. Additionally, the sensing device 492 may be provided on the front surface of the upper cap decoration 43 adjacent to the panel assembly 30.

Meanwhile, the panel assembly 30 may be inserted and mounted on the front surface of the door body 40. For example, the side decoration 44 may protrude further forward and may be in contact with both ends of the panel assembly 30. Additionally, the upper surface of the panel assembly 30 forms the same plane as the upper cap decoration 43 to form the upper surface of the door 70, and the lower surface of the panel assembly 30 may form the same plane as the lower cap decoration 48 to form the lower surface of the door 70.

The panel assembly 30 is formed in a plate shape, and may form the outer appearance of the front surface of the door 70 when mounted on the front surface of the door body 40. The panel assembly 30 forms the outer appearance of the front surface of the door 70, so it may be referred to as a door panel, and since it forms the outer appearance of the front surface of the refrigerator 1, it may also be referred to as an exterior panel.

Additionally, if necessary, the panel assembly 30 may have a structure that may be mounted separately from the door body 40 for service and maintenance.

The front surface of the panel assembly 30 is exposed to the front when mounted on the door body 40 and may form a substantial outer appearance of the front surface of the door 70. In other words, the color of the outer appearance of the front surface of the door 70 may be determined by the color of the front surface of the panel assembly 30. In addition, the entire front surface of the panel assembly 30 may be configured to glow in a color designated by the user and may also be changed to various colors selected by the user to express the front color of the door 70 in various ways.

In addition, even when the panel assembly is mounted, the space behind the door may be visualized through the seeing-through assembly.

Hereinafter, the structure of the panel assembly 30 will be examined in detail with reference to the drawings.

Figure 9:
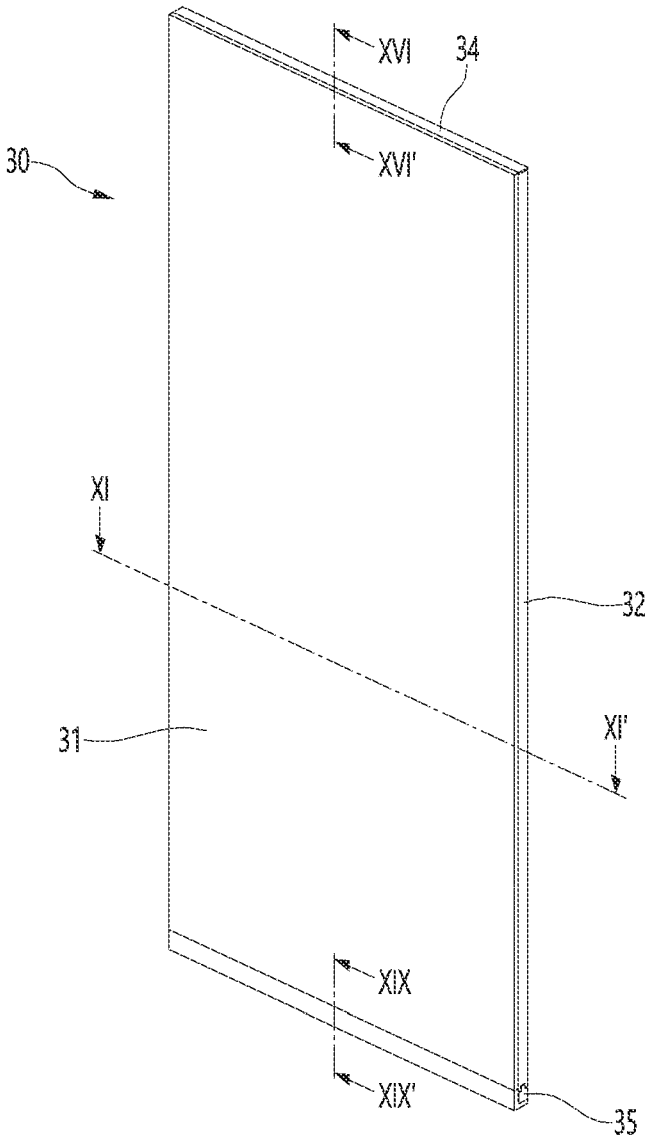
FIG. 9 is a perspective view illustrating the panel assembly viewed from the front.
Figure 10:
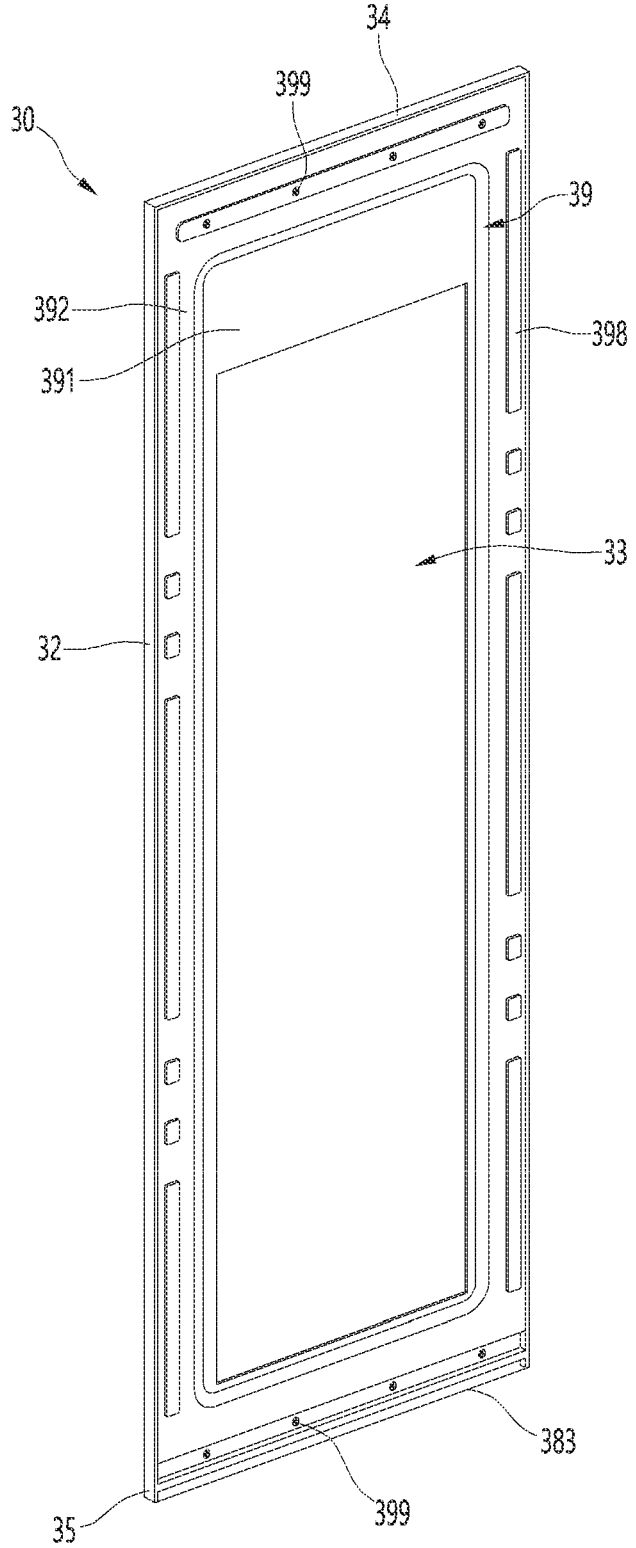
FIG. 10 is a perspective view illustrating the panel assembly viewed from the rear.
Figure 11:
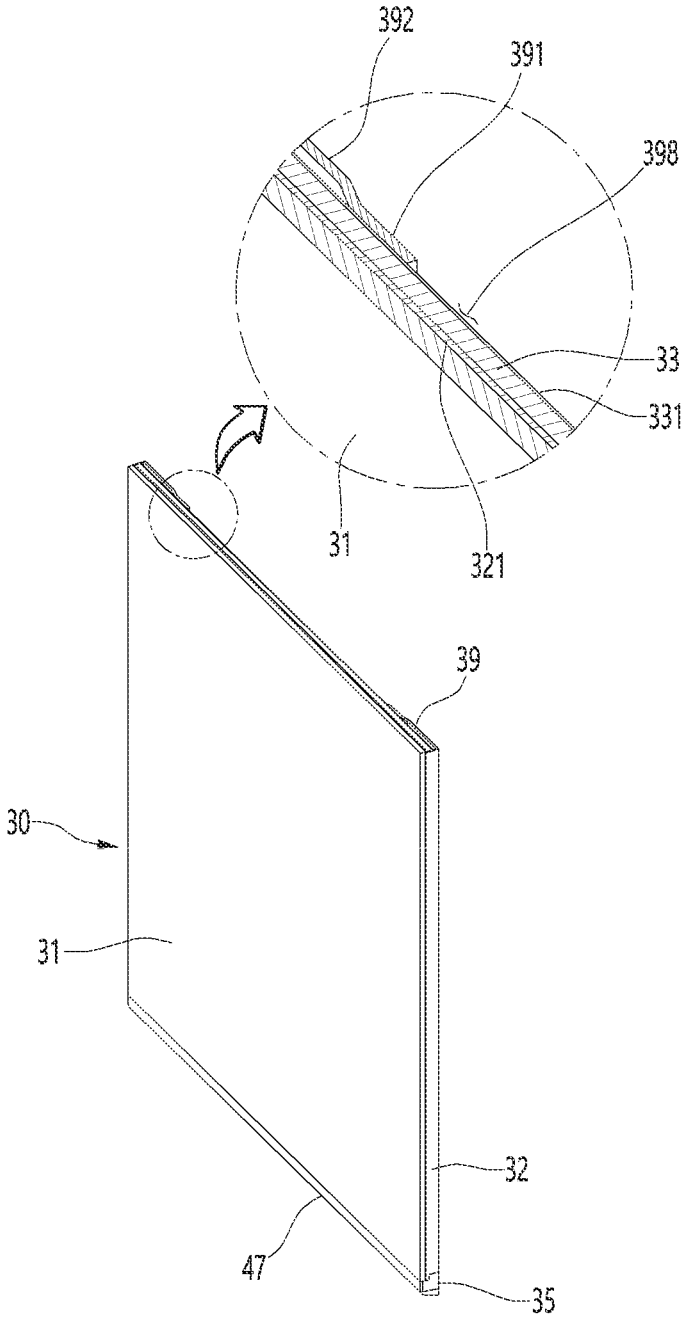
FIG. 11 is a perspective view taken along line XI-XI' of FIG. 9.
Figure 12:
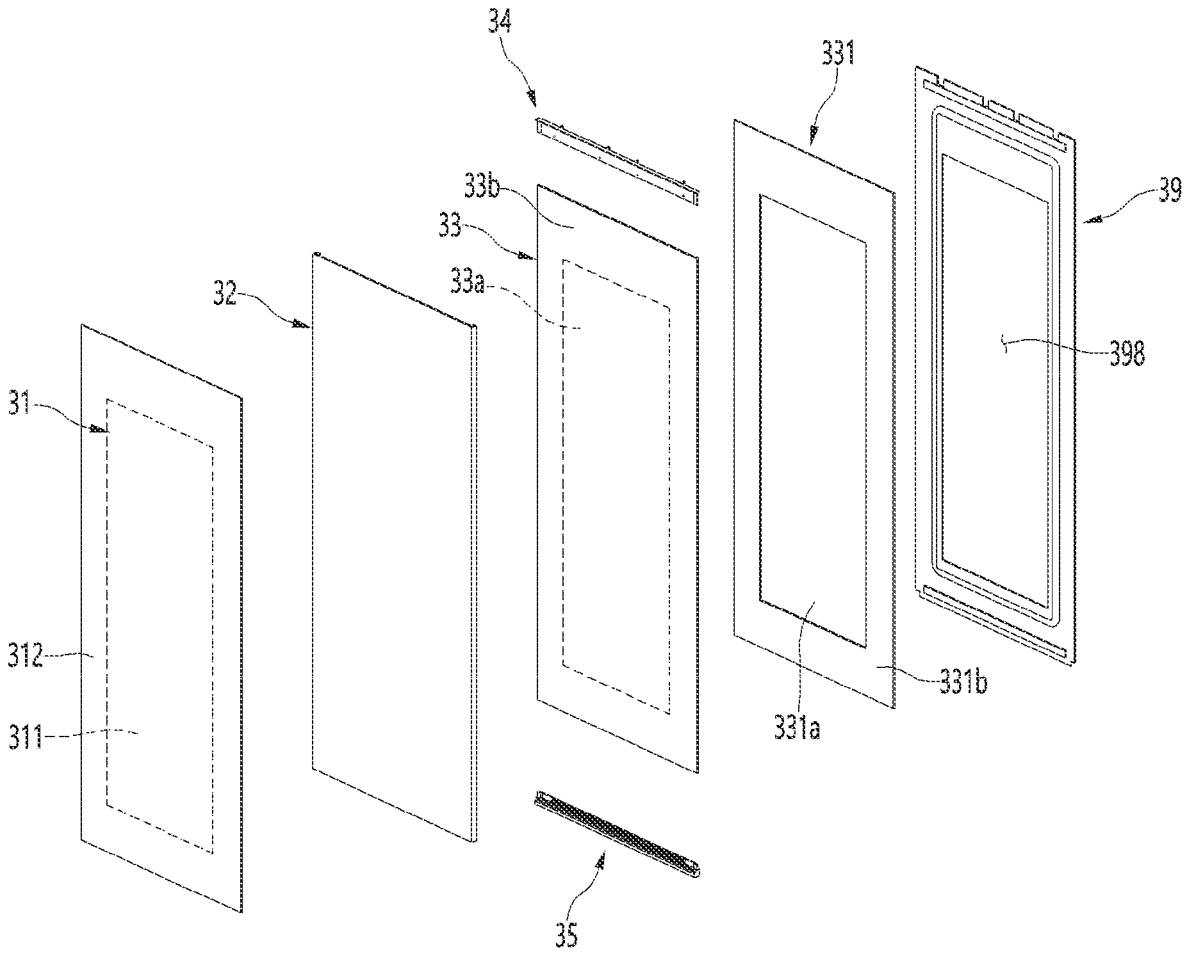
FIG. 12 is an exploded perspective view illustrating the panel assembly.

FIG. 9 is a perspective view illustrating the panel assembly viewed from the front, FIG. 10 is a perspective view illustrating the panel assembly viewed from the rear, FIG. 11 is a perspective view taken along line XI-XI' of FIG. 9, and FIG. 12 is an exploded perspective view illustrating the panel assembly.

As illustrated in the drawing, the panel assembly 30 may include a panel 31 that forms the outer appearance of the front surface, and a lighting device 36 that irradiates light so that the panel 31 glows. Additionally, the panel assembly 30 may include a back cover 39 that forms the rear of the panel assembly 30. Additionally, the panel assembly 30 may further include a light guide plate 33 that guides the light emitted from the lighting device 36. Additionally, the panel assembly 30 may further include a transparent member 32 on which the light guide plate 33 and the panel 31 are mounted.

In addition, the panel assembly 30 may further include an upper bracket 34 forming the upper surface of the panel assembly 30 and a lower bracket 35 forming the lower surface of the panel assembly 30. Additionally, the lighting device 36 may be mounted on the lower bracket 35. Additionally, the panel assembly 30 may further include a back cover 39 forming a rear.

Looking at this in more detail, the panel 31 may be formed in a rectangular plate shape and may be made of a material capable of transmitting light. For example, the panel 31 may be made of a glass material such as blue glass, white glass, or evaporated glass, or another material that allows light to pass through, such as ABS, PMMA, or PC. Additionally, the panel 31 may also be referred to as a transparent plate or an out plate.

The panel 31 may be formed so that light reflected by the light guide plate 33 can be transmitted. Additionally, the panel 31 may be formed to have colors. In other words, when the lighting device 36 is turned off, the front color of the door 70 may be expressed by the color of the panel 31. The color of the panel 31 cannot be changed when the lighting device 36 is turned off, and the user can select and install a desired color by replacing the panel assembly 30.

In addition, when the lighting device 36 is turned off, the panel 31 may prevent the internal components of the panel assembly 30 from being visible to the outside through the panel 31 due to the color of the panel 31 itself.

At this time, the panel 31 may be formed to have a color with a brightness of 0 or more other than black when the lighting device 36 is turned off. In other words, when the refrigerator 1 is installed, the front surface of the refrigerator 1 may be displayed in a color other than black, and the front color of the refrigerator 1 may change according to the operation of the lighting device 36.

For this purpose, a color layer may be formed on the panel 31. The color layer allows the panel 31 to have color, and may be formed on the entire front surface or rear of the panel 31. As an example, the color layer may be formed by colored printing or film attachment.

Meanwhile, the color layer may include a first color part 311 and a second color part 312. The first color part 311 may be formed at a position corresponding to the seeing-through assembly 45 or the opening. Additionally, the first color part 311 may be formed to overlap at least a portion of the seeing-through assembly 45 or the opening 398 so that the space behind the door 70 may be seen through from the outside. Additionally, the first color part 311 may correspond to the seeing-through region 701.

Additionally, a second color part 312 may be formed around the first color part 311. The second color part 312 may be formed from the outside of the first color part 311 to the outer end of the panel 31. Additionally, the second color part 312 may be formed in the same color as the first color part 311, but may have lower saturation.

In detail, the first color part 311 is open at the rear to enable seeing-through, and the second color part 312 is blocked by the internal components of the door 70. Therefore, when the first color part 311 and the second color part 312 are formed with colors of the same saturation, the first color part 311, that is, the visible region, appears brighter, making it difficult to feel a sense of unity in appearance.

Therefore, even if the saturation of the first color part 311 is made higher and the rear of the first color part 311 is open, the boundary of the first color part 311 and the second color part 312 is not visible and has the same brightness, so when the see-through light 491 is turned off, the boundary of the first color part 311, that is, the visible region, is not clearly distinguished, so that the panel 31 has a sense of unity as a whole.

Of course, the saturation of the first color part 311 is somewhat higher than that of the second color part 312, but when the see-through light 491 is turned on, the space behind the door 70 may be sufficiently visible.

The light guide plate 33 may be located at the rear spaced apart from the panel 31 and may be configured to guide the light emitted from the lighting device 36 disposed below the light guide plate 33 forward toward the panel 31.

For example, the light guide plate 33 may be made of transparent acrylic, plastic, or transparent polymer material. Accordingly, the light guide plate 33 may be made transparent and the seeing-through assembly disposed at the rear may be visible through the light guide plate 33 when the transparent light 491 is turned on.

Additionally, a diffusion agent may be added to the light guide plate 33 to allow light incident on the light guide plate 33 to diffuse, or a pattern for light diffusion may be formed. Therefore, light may be transmitted to the panel 31 by the light guide plate 33, and at this time, the pattern of the light guide plate 33 may be set so that the entire front surface of the panel 31 is uniformly bright and glows. In particular, the pattern of the light guide plate 33 may reflect the light emitted from the lighting device 36 toward the front and irradiate the light toward the panel 31.

In detail, a first pattern part 33*a* and a second pattern part 33*b* may be formed on the light guide plate 33. The first pattern part 33*a* may be formed to overlap at least a portion of the opening 398 or the seeing-through assembly 45 and may be formed to enable seeing-through of the rear space of the door 70. In other words, the first pattern part 33*a* may be patterned to a degree that allows rear seeing-through. Of course, the first pattern part 33*a* may not have a pattern for reflection. Accordingly, even when the light guide plate 33 blocks the seeing-through assembly 45 from the front, the space behind the door 70 may be seen through the first pattern part 33*a*.

The second pattern part 33*b* may be formed along the perimeter of the first pattern part 33*a* and may be formed between the first pattern part 33*a* and the perimeter of the light guide plate 33. The second pattern part 33*b* may be formed to reflect light moving along the light guide plate 33, and may also be formed to be opaque.

A reflective layer 331 may be formed on the rear of the light guide plate 33. The reflective layer 331 is used to reflect light guided along the light guide plate 33 forward and may be disposed on the rear of the light guide plate 33. The reflective layer 331 may be formed in the shape of a thin plate, sheet, or film. Therefore, the reflective layer 331 may also be referred to as a reflector, a reflective sheet, or a reflective film.

For example, the reflective layer 331 may be coated with a color or material for light reflection on the surface in contact with the light guide plate 33. Accordingly, light moving along the light guide plate 33 may be reflected toward the front of the light guide plate 33 by the reflective layer 331.

In detail, the reflective layer 331 may include a first region 331*a* and a second region 331*b*. The first region 331*a* is a portion for the user to see through the rear of the door 70 and may be formed to at least partially overlap the viewing assembly 45 or the opening 398. Additionally, the first region 331*a* may be transparent to allow rear seeing-through. Additionally, the first region 331*a* may be formed in the form of an opening penetrating the reflective layer 331. Therefore, even when the reflective layer 331 is disposed on the rear of the light guide plate 33, the rear of the door can be seen through the light guide plate 33 and the reflective layer 331.

The second region 331*b* may be formed along the perimeter of the first region 331*a*. Additionally, the second region 331*b* may be formed from the outside of the first region 331*a* to the outer end of the second reflective layer 331. The second region 331*b* may be opaque and may be formed to reflect light forward.

In this way, the first color part 311, the first pattern part 33*a*, and the first region 331*a* may all be formed at positions corresponding to the seeing-through assembly 45. In addition, it may have a structure that allows the rear of the first color part 311, the first pattern part 33*a*, and the first region 331*a* to see through.

In addition, reflective layers are further formed on both left and right sides and the upper surface of the light guide plate 33, excluding the lower surface where the lighting device 36 is mounted, so that light does not leak around the light guide plate 33 and directs all toward the inside of the light guide plate 33, and thus the panel 31 can be made to glow more brightly and evenly.

A transparent member 32 may be provided between the panel 31 and the light guide plate 33. The light guide plate 33 and the panel 31 are fixedly mounted on the transparent member 32, and in particular, the light guide plate 33 may be maintained at a certain distance from the panel 31.

The front surface of the transparent member 32 supports the panel 31, and both left and right sides of the transparent member 32 may restrain the light guide plate 33 disposed at the rear. Since the panel 31 and the light guide plate 33 are mounted on the transparent member 32, it may be referred to as a support member, since it is formed to allow light to pass through, it can also be referred to as a transparent plate, and since it can form a structure including the side of the panel assembly 340, it can also be referred to as a panel frame.

Meanwhile, the transparent member 32 may be formed of a material capable of transmitting light. As an example, the transparent member 32 may be formed of an optically transparent ABS material. Additionally, the transparent member 32 may be made of various transparent plastic materials, such as polycarbonate (PC), acrylic, or the like. Light reflected from the light guide plate 33 may be transmitted and pass through the panel 31.

An upper bracket 34 may be provided at the upper end of the panel assembly 30. The upper bracket 34 may form the upper surface of the panel assembly 30. In addition, the upper bracket 34 may form a structure coupled to the transparent member 32 and a structure coupled to the back cover 39.

The upper bracket 34 may extend from the upper left end to the right end of the transparent member 32, cover the transparent member 32 and the light guide plate 33, and form an outer appearance of an upper surface of the panel assembly 30.

A lower bracket 35 may be provided at the lower end of the panel assembly 30. The lower bracket 35 may form the lower surface of the panel assembly 30. In addition, the lower bracket 35 may form a structure coupled to the transparent member 32 and a structure coupled to the back cover 39.

Additionally, a lighting device 36 may be mounted on the lower bracket 35. The lighting device 36 may be provided inside the lower bracket 35 to irradiate light toward the light guide plate 33 and may be mounted on and may be assembled and mounted together with the lower bracket 35 in a state of being mounted on the lower bracket 35.

The lower bracket 35 may be coupled to the lower end of the transparent member 32 and may extend from the lower left end to the right end of the transparent member 32. Additionally, the back cover 39 may be coupled to the rear of the lower bracket 35.

Meanwhile, the back cover 39 forms the rear of the panel assembly 30 and may be combined with the upper bracket 34 and the lower bracket 35. The back cover 39 may be made of a metal material such as stainless steel or aluminum. Additionally, the back cover 39 may be formed in a size corresponding to the size of the panel assembly 30 and may form the entire shape of the rear of the panel assembly 30.

A cover opening 398 may be formed in the back cover 39 at a position corresponding to the seeing-through assembly 45. Additionally, the cover opening 398 may be formed to have a size corresponding to that of the seeing-through assembly 45. Accordingly, when viewed from the front of the panel assembly 30, the see-through assembly 45 is visible through the cover opening 398 and is configured to view the space behind the door 70.

Hereinafter, the structure of the transparent member 32, the lower bracket 35, the lighting device 36, and the upper bracket 34, which are the main components included in the panel assembly, will be examined in more detail with reference to the drawings.

Figure 13:
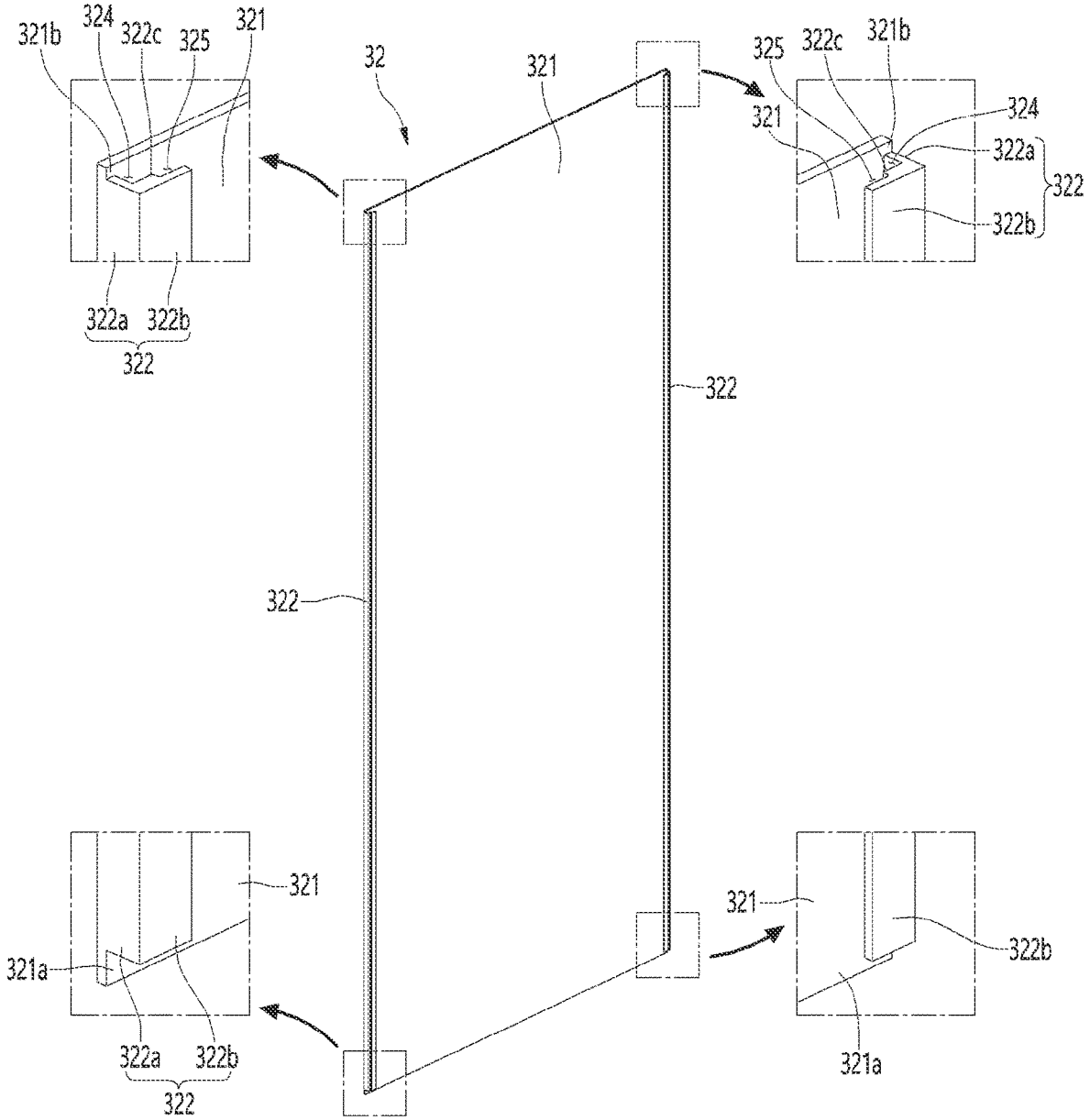
FIG. 13 is a perspective view illustrating the transparent member which is a component of the panel assembly viewed from the rear.

FIG. 13 is a perspective view illustrating the transparent member which is a component of the panel assembly viewed from the rear.

As illustrated in the drawing, the transparent member 32 may be entirely formed by injection molding of a resin material, and the panel 31 is mounted on the front surface with respect to the transparent member 32, and the light guide plate 33 may be mounted on the rear.

The transparent member 32 may include a plate-shaped front surface portion 321 and side portions 322 protruding rearward from both left and right ends of the front surface portion 321. The front surface portion 321 may be disposed between the panel 31 and the light guide plate 33, and the front surface may support the panel 31 and the rear may support the light guide plate 33.

An adhesive member 313 is applied around the front surface of the front surface portion 321 so that the panel 31 may be adhered to the front surface of the transparent member 32. Additionally, the front surface portion 321 may have a structure that connects the side portions 322 on both left and right sides. In other words, the front surface portion 321 may be formed continuously between the side portions 322 and may extend from the side portion 322 on one side to the side portion 322 on the other side.

In addition, when the light guide plate 33 is mounted, the rear of the front surface portion 321 may be maintained in contact with the front surface of the light guide plate. Accordingly, the light guide plate 33 may always maintain a constant distance from the panel 31.

The side portion 322 may be formed along both left and right ends of the light guide plate 33. In addition, the side portion 322 may be formed to be stepped from the upper end and the lower end of the front surface portion 321 and be formed to fit with the side ends of the upper bracket 34 and the lower bracket 35.

In addition, the panel 31 and the light guide plate 33 as well as the upper bracket 34 and the lower bracket 35 may be mounted on the transparent member by the structure of the front surface portion 321 and the side portion 322.

In detail, the side portion 322 may include a first part 322*a* extending rearward from both left and right ends of the front surface portion 321 and a second part 322*b* bent at the end portion of the first part 322*a*.

The first part 322*a* may extend perpendicular to the front surface portion 321 from both left and right ends of the front surface portion 321 and may form a side of the panel assembly 30.

The second part 322*b* may be bent inward at the extended end portion of the first part 322*a*. In other words, the pair of second parts 322*b* formed on the pair of first parts 322*a* may extend in directions facing each other.

The second part 322*b* may extend perpendicular to the first part 322*a*, and may be formed to restrain the light guide plate 33 and both end portions of the upper bracket 34 and the lower bracket 35 at the same time. Additionally, the second part 322*b* may extend from the upper end to the lower end of the first part 322*a* and support both left and right ends of the back cover 39.

A third part 322*c* may be formed between the first part 322*a* and the second part 322*b*. The second part 322*b* and the third part 322*c* may extend from the upper end to the lower end of the first part 322*a*. In addition, the third part 322*c* may protrude from the front surface of the second part 322*b*, that is, the surface facing the front surface portion 321, and the front surface of the second part 322*b* may be formed to have a stepped shape.

A light guide plate insertion space 324 and a bracket insertion space 325 may be formed in the side portion 322 by the first part 322*a*, second part 322*b*, and third part 322*c*, respectively.

In detail, the third part 322*c* is formed parallel to the front surface portion 321, and a light guide plate insertion space 324 may be formed between the front surface portion 321 and the third part 322*c*. At this time, the third part 322*c* may extend from the rear end of the first part 322*a*, and the distance between the front surface portion 321 and the third part 322*c* is formed to correspond to the thickness of the light guide plate 33, and thus the light guide plate 33 may be slide-in inserted. In addition, in a state where the light guide plate 33 is inserted, both left and right ends of the light guide plate 33 may be restricted to both ends of the transparent member 32. At this time, the front surface of the light guide plate 33 may be in contact with the rear of the front surface portion 321.

In addition, in a state where the light guide plate 33 is inserted into the light guide plate insertion space 324, the lower end of the light guide plate 33 may be located at a position facing the lighting device 36. In particular, the light guide plate 33 may be located on the same extension line as the light source 362 of the lighting device 36, and in a state of being inserted and fixed in the light guide plate insertion space 324, flow in the light guide plate 33 in the front and rear direction may be restricted.

Additionally, a second part 322*b* may be formed at the extended end portion of the third part 322*c*. The second part 322*b* may be formed to be stepped from the third part 322*c* and may be located further rear than the third part 322*c*. In other words, the third part 322*c* may be formed to protrude further forward than the front surface of the second part 322*b*.

The second part 322*b* is disposed parallel to the front surface portion 321, and one sides of the upper bracket 34 and the lower bracket 35 may be inserted in the space between the front surface portion 321 and the second part 322*b*. In particular, the upper bracket 34 and the lower bracket 35 may be slidably inserted from above and below the transparent member 32, respectively, while the light guide plate 33 is mounted on the side portion 322.

At this time, the height of the step between the third part 322*c* and the second part 322*b* may be formed to correspond to the inserted portion of the upper bracket 34 and the lower bracket 35, that is, the thickness of the upper bracket mounting part 344 and the lower bracket mounting part 352*b*. Therefore, when the upper bracket 34 and the lower bracket 35 are mounted in the bracket insertion space 325 in a state where the light guide plate 33 is mounted in the light guide plate insertion space, the upper and lower ends of the light guide plate 33 may be supported from the rear by the upper bracket 34 and the lower bracket 35.

An upper protrusion 321*b* and a lower protrusion 321*a* that protrude further than the upper and lower ends of the side portion 322 may be formed at the upper and lower ends of the front surface portion 321. Accordingly, the upper bracket 34 and the lower bracket 35 mounted on the upper and lower ends of the transparent member 32 can be assembled with directionality, thereby preventing misassembly, and a more robust fixed installation of the upper bracket 34 and lower brackets 35 may be possible.

The upper bracket 34 and the lower bracket 35 are inserted into the bracket insertion space 325, and are simultaneously seated on the stepped parts of the upper end and the lower end of the side portion 322 and the front surface portion 321 and thus may be tightly combined with the transparent member 32. In addition, the upper bracket 34 and the lower bracket 35 form the upper and lower surfaces of the panel assembly 30 in a state of being combined with the transparent member 32.

In addition, in a state where the upper bracket 34 and the lower bracket 35 are mounted, the back cover 39 is coupled to the upper bracket 34 and the lower bracket 35 and thus an overall combination structure of the panel assembly 30 may be completed.

Figure 14:
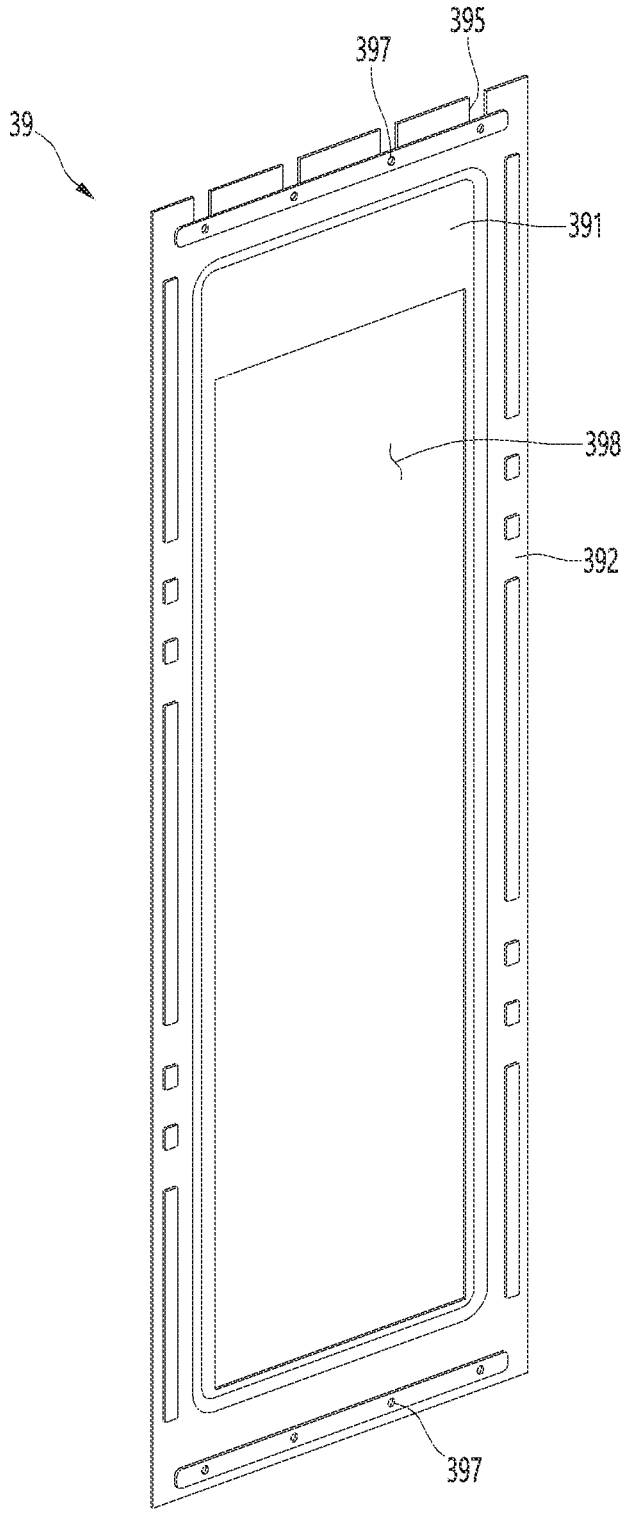
FIG. 14 is a perspective view illustrating the back cover which is a component of the panel assembly viewed from the rear.

FIG. 14 is a perspective view illustrating the back cover which is a component of the panel assembly viewed from the rear.

As illustrated in the drawing, the back cover 39 is formed in a plate shape made of metal and may form the rear of the panel assembly 30.

The back cover 39 may include a cover peripheral portion 391 and a cover protrusion 392, and the plate-shaped back cover 39 may have the cover peripheral portion 391 and the cover protrusion 392 by forming.

The cover peripheral portion 391 may form a perimeter of the back cover 39 and may be formed along a perimeter of the cover protrusion 392. In addition, the upper and lower ends of the cover peripheral portion 391 are supported by the upper bracket 34 and the lower bracket 35, and both left and right side ends of the cover peripheral portion 391 may be supported by the side portion 322.

In addition, a plurality of screws 399 may be fastened along the upper end and the lower end of the cover peripheral portion 392, and the screws 399 penetrate the back cover 39, are fastened to the upper bracket 34 and the lower bracket 35 so that the back cover 39 may be fixedly mounted.

In addition, the protrusion opening 395 may be formed at the upper end of the back cover 39 through which the upper protrusion 343 protruding backward from the rear of the upper bracket 34 passes when the upper bracket 34 is mounted.

Meanwhile, the cover protrusion 391 may be formed inside the cover peripheral portion 391, that is, at the center of the back cover 39, and may protrude further forward than the cover peripheral portion 391. In addition, when the back cover 39 is installed, the rear of the light guide plate 33 may be supported by the cover protrusion 392. Accordingly, the light guide plate 33 supported at both ends has a large plate-shaped structure, but can be supported more stably by the cover protrusion 392 in a state where the back cover 39 is mounted.

Additionally, a cover opening 398 may be formed in the center of the back cover 39 where the cover protrusion 392 is formed. The cover opening 398 may be formed at a position corresponding to the seeing-through assembly 45, and is formed so that at least a portion of the front surface of the seeing-through assembly 45 may be seen through the cover opening 398.

When the panel assembly 30 is mounted on the door body 40, the back cover 39 may be in contact with the front plate 41. At this time, the cover opening 398 allows the front surface of the seeing-through assembly 45 to be visible through the cover opening 398, and the rear space of the door 70 according to the on-off operation of the seeing-through light 491.

Figure 15:
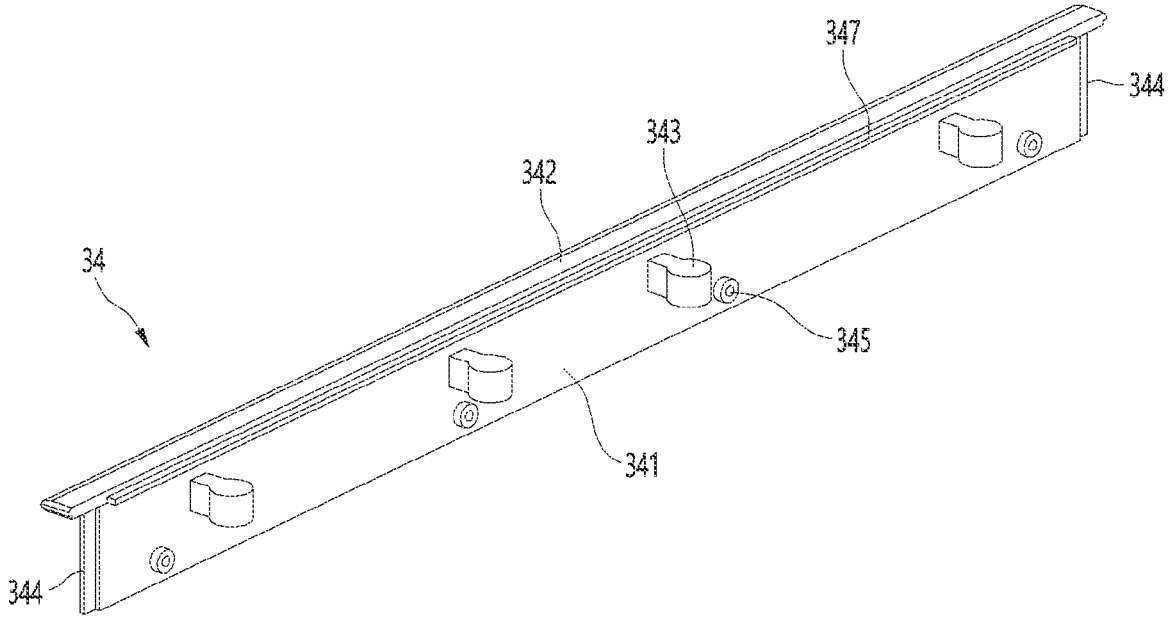
FIG. 15 is a perspective view illustrating the upper bracket which is a component of the panel assembly viewed from the rear.
Figure 16:
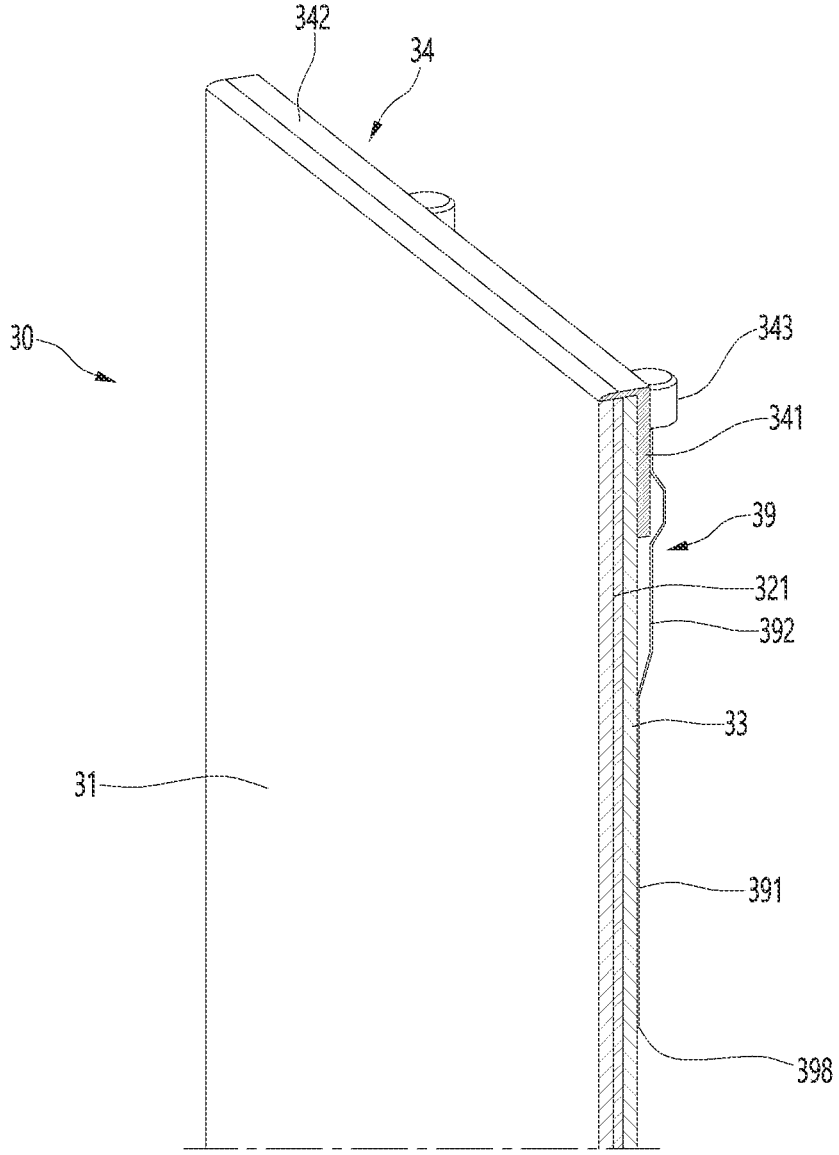
FIG. 16 is a perspective view taken along line XVI-XVI' of FIG. 9.

FIG. 15 is a perspective view illustrating the upper bracket which is a component of the panel assembly viewed from the rear, and FIG. 16 is a perspective view taken along line XVI-XVI' of FIG. 9.

As illustrated in the drawing, the upper bracket 34 may form the upper surface of the panel assembly 30 in a state where the upper bracket 34 is mounted on the transparent member 32.

The upper bracket 34 may overall include an upper bracket extension part 341 and an upper bracket upper surface portion 342. The upper bracket extension part 341 is for mounting the upper bracket 34, is formed parallel to the panel 31 and the light guide plate 33, and may extend in the vertical direction.

In addition, upper bracket mounting parts 344 that are stepped forward may be formed on both left and right ends of the upper bracket extension part 341. The upper bracket mounting part 344 may be formed to be stepped apart from the upper bracket extension part 341 and may be located ahead of the upper bracket extension part 341.

The upper bracket mounting part 344 may be formed to have a thickness corresponding to the width of the bracket insertion space 325, and may be slidably inserted from above to below the bracket insertion space 325.

In a state where the upper bracket 34 is mounted on the transparent member 32, the upper bracket mounting part 344 is fixed to the bracket insertion space 325, and the remaining upper bracket extension parts 341 are exposed between the side portions 322 on the both sides and may be supported and coupled to the upper end of the back cover 39.

An upper protrusion 343 protruding rearward may be formed on the rear of the upper bracket extension part 341. The upper protrusion 343 is for mounting the panel assembly 30, and protrudes from the upper bracket extension 341 by a predetermined length and thus may be formed to be coupled to the upper mounting part 431 of the upper cap decoration 43.

An upper bracket screw hole 345 for fastening the screw 399 may be formed in the upper bracket extension part 341. The upper bracket screw hole 345 may be formed at a position corresponding to the cover screw hole 397. Accordingly, when the back cover 39 is mounted, the screw 399 may be fastened to sequentially pass through the cover screw hole 397 and the upper bracket screw hole 345.

A cover supporter 347 protruding rearward may be formed at the upper end of the rear of the upper bracket extension part 341. The cover supporter 347 is in contact with the upper end of the back cover 39 when the back cover 39 is installed, and may maintain the correct installation position of the back cover 39.

Meanwhile, the upper bracket upper surface portion 342 may be formed at the upper end of the upper bracket extension part 341. The upper bracket upper surface portion 342 forms the upper surface of the panel assembly 30 and may extend in a direction that intersects perpendicularly to the upper bracket extension part 341.

In detail, the upper bracket upper surface portion 342 may extend forward from the upper end of the upper bracket extension part 341. The front end of the upper bracket upper surface 342 may extend to cover at least a portion of the upper end of the panel 31, and may be formed to completely cover the upper end of the transparent member 32 and the light guide plate 33.

Accordingly, the upper bracket 34 may be coupled and fixed to the upper end of the transparent member 32, and is fixed to the back cover 39 by the screw 399, thereby restricting the upward movement of the light guide plate 33 and forming the upper surface shape of the panel assembly 30.

Meanwhile, the upper bracket upper surface portion 342 may be formed to have a slope that becomes lower as it extends forward. Due to this structure, when the panel assembly 30 is viewed from the front, the front end of the upper bracket upper surface portion 342 is minimized and not easily visible, and the outer appearance of the front surface of the panel assembly 30 may substantially be formed by the panel 31.

Figure 17:
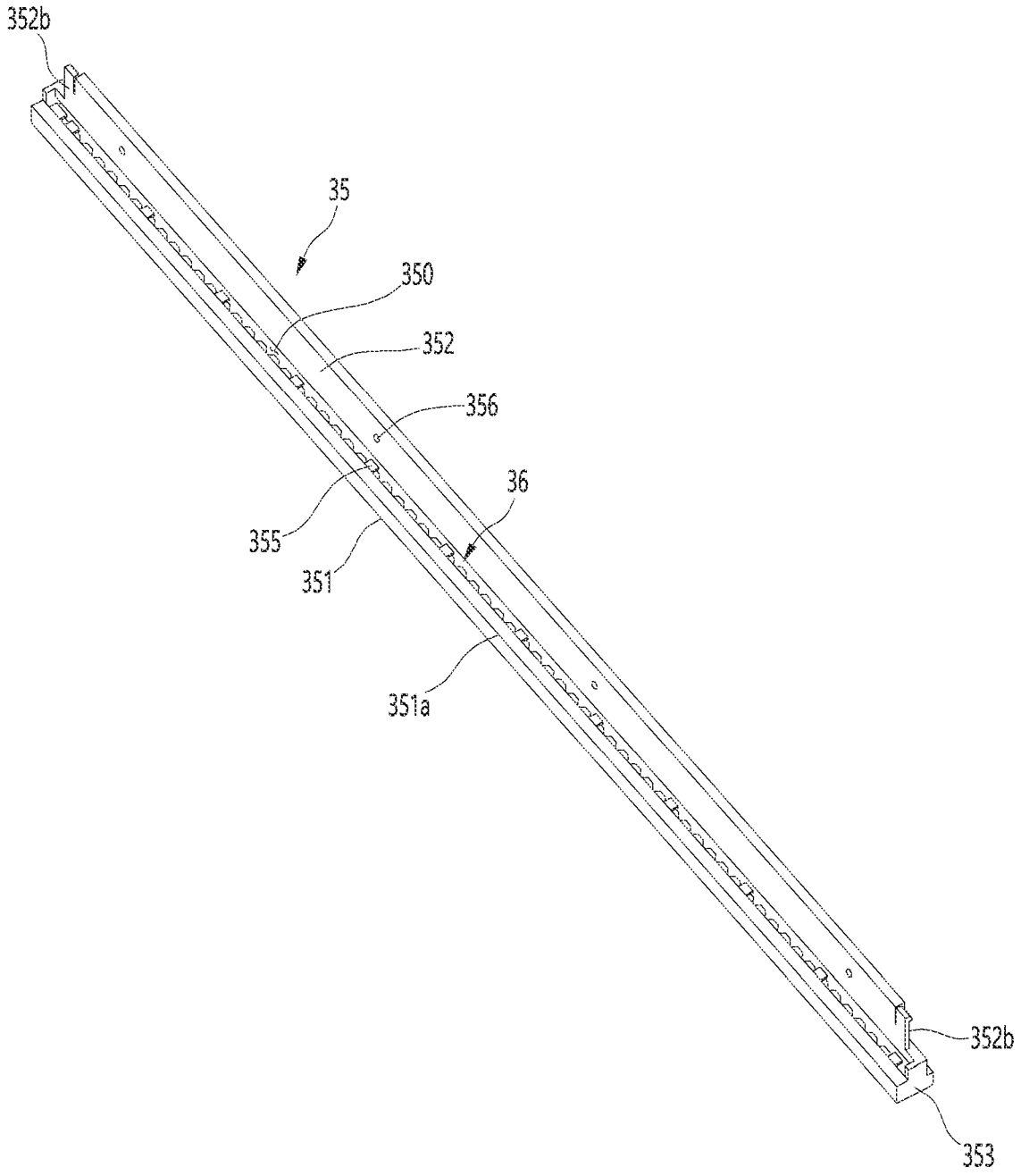
FIG. 17 is a perspective view illustrating a state where a lighting device is mounted on a lower bracket, which is a component of the panel assembly.
Figure 18:
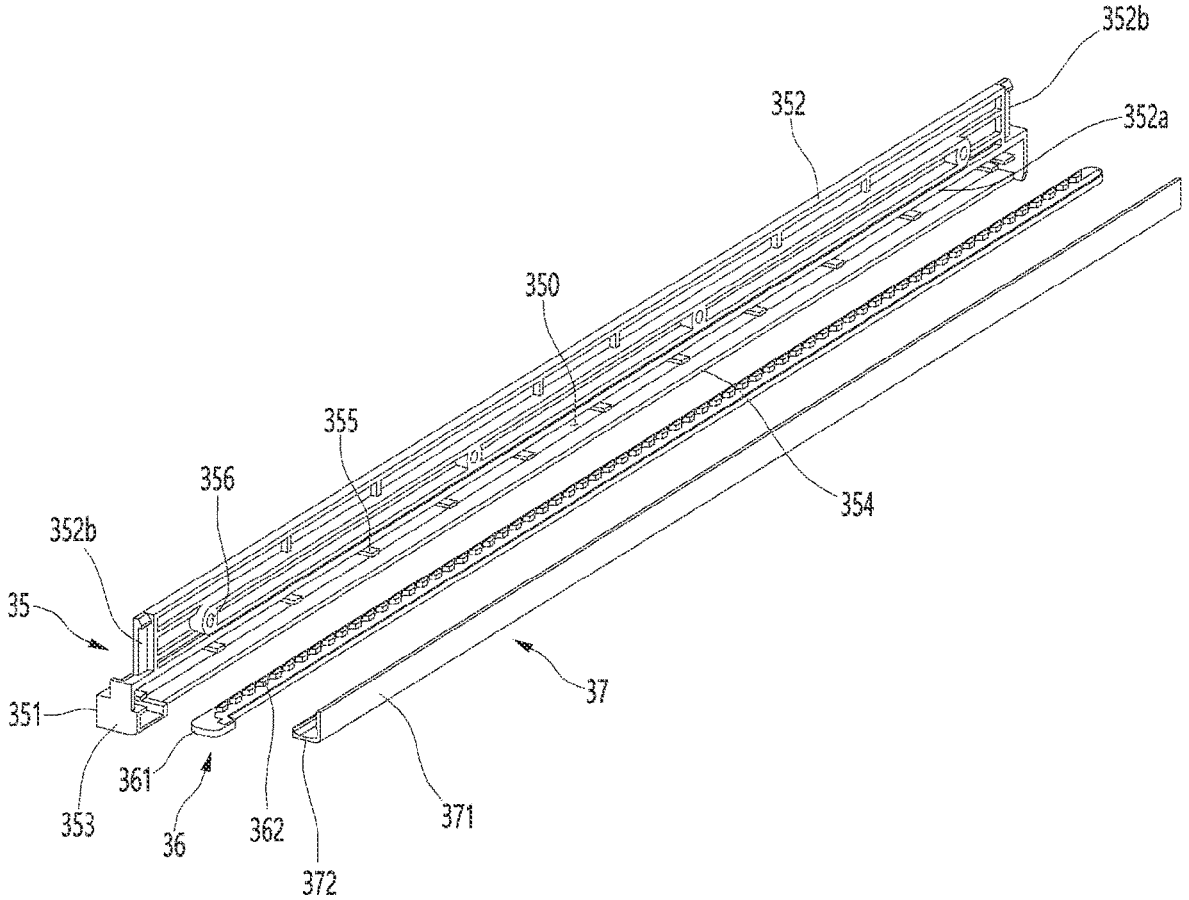
FIG. 18 is an exploded perspective view illustrating the lower bracket, the lighting device, and the light supporter.
Figure 19:
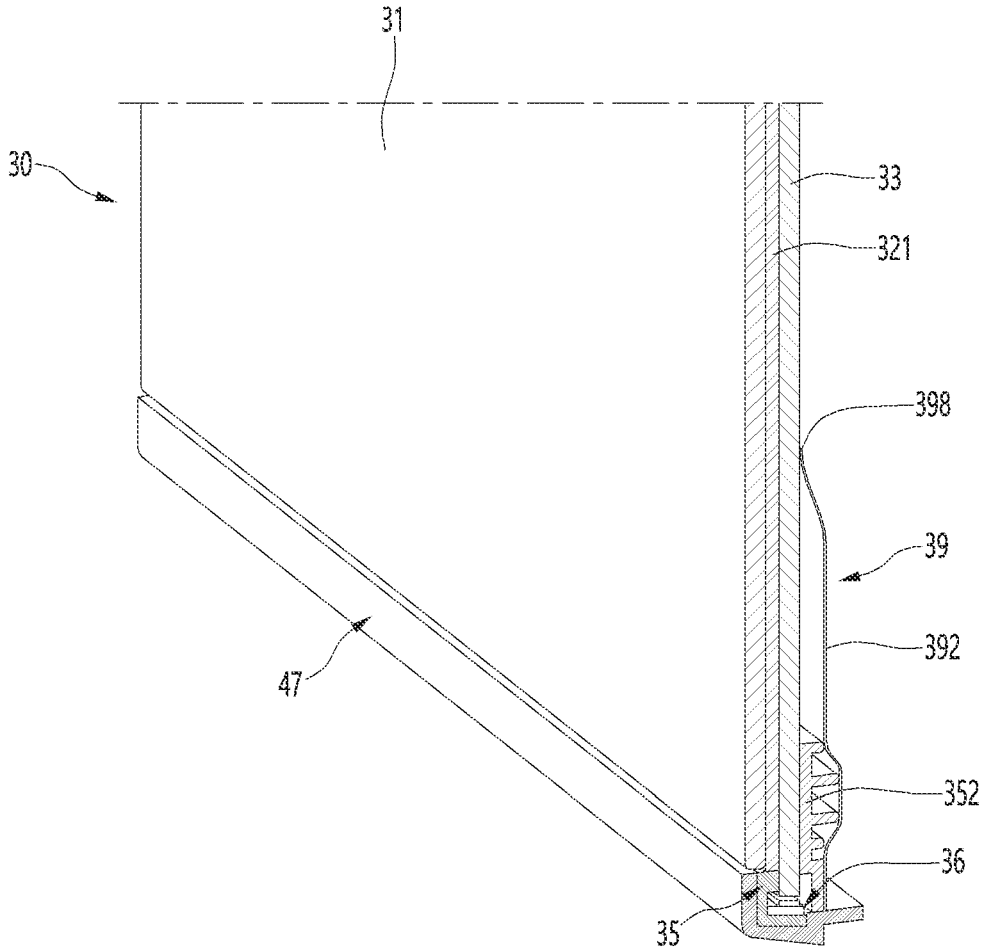
FIG. 19 is a perspective view taken along line XIX-XIX' of FIG. 9.

FIG. 17 is a perspective view illustrating a state where a lighting device is mounted on a lower bracket, which is a component of the panel assembly, FIG. 18 is an exploded perspective view illustrating the lower bracket, the lighting device, and the light supporter, and FIG. 19 is a perspective view taken along line XIX-XIX' of FIG. 9.

As illustrated in the drawing, the lower bracket 35 is mounted on the transparent member 32 to cover the panel 31, the transparent member 32, and the lower end of the light guide plate 33. In addition, when the lower decoration 47 is separated, the outer appearance of the lower end of the panel assembly 30 may be formed.

The lower bracket 35 may overall include a lower bracket front surface portion 351, a lower bracket rear portion 352, a lower bracket side portion 353, and a lower bracket lower surface portion 354.

The lower bracket front surface portion 351 may form the front surface shape of the lower bracket 35, and a panel support part 351*a* is formed at the upper end of the lower bracket front surface portion 351 to support the lower end of the panel 31.

The panel support part 351*a* may protrude more upward than the upper end of the light source of the lighting device 36, and may protrude at a set height to prevent the lighting device 36, especially the light source 362, from being exposed to the front. In addition, the panel support part 351*a* may cover regions that may be generated due to intensive light irradiation at the lower end of the light guide plate 33 and the lower end of the panel 31, which are very adjacent to the lighting device 36, so that it is also possible to prevent light spots from being formed in the panel 31.

Meanwhile, the lower bracket side portion 353 forms the side of the lower bracket 35 and may protrude more upward than the lower bracket front surface portion 351. The upper end of the lower bracket side portion 353 may protrude upward than the panel support part 351*a*, and therefore the stepped part at the lower end of the side of the transparent member 32 may be coupled to engage with the lower bracket front surface portion 351 and the lower bracket side portion 353.

The lower bracket rear portion 352 forms the rear of the lower bracket 35 and protrudes more upward than the lower bracket front surface portion 351 and the lower bracket side portion 353 to support the light guide plate 33 from the rear and to combine with the back cover 39.

In addition, lower bracket mounting parts 352*b* that are stepped forward may be formed on both left and right ends of the lower bracket rear portion 352. The lower bracket mounting part 352*b* may be slidably inserted from the bottom to the top of the bracket insertion space 325.

A lower bracket screw hole 356 into which a plurality of screws 399 are fastened may be formed in the lower bracket rear portion 352. The lower bracket screw hole 356 is formed at a position corresponding to the cover screw hole 397, and when the back cover 39 is mounted, the screw 399 may be fastened to sequentially pass through the cover screw hole 397 and the lower bracket screw holes 356.

Meanwhile, a bracket opening 352*a* may be formed in the lower bracket rear portion 352. The bracket opening 352*a* is formed at a position facing the lower bracket front surface part 351, and may be formed to open at the rear of the accommodation space 350 where the lighting device 36 is mounted. In addition, the lighting device 36 may be entered and exited through the bracket opening 352*a*. In addition, the bracket opening 352*a* may be covered by the back cover 39.

The lower bracket lower surface portion 354 may form the lower surface of the lower bracket 35 and the bottom surface of the space where the lighting device 36 is mounted. Meanwhile, a light guide plate support part 355 protruding rearward may be formed on the lower bracket front surface portion 351. A plurality of light guide plate support parts 355 may protrude rearward at regular intervals along the lower bracket front surface portion 351.

The light guide plate support part 355 may extend to restrain the lighting device 36 from above. The light guide plate support part 355 and the lower bracket lower surface portion 354 may restrict the lighting device 36 from above and below to restrict the upward and downward flow of the lighting device 36. Additionally, the upper surface of the light guide plate support part 355 may support the lower end of the light guide plate 33.

Meanwhile, a lighting device 36 may be provided inside the lower bracket 35. The lighting device 36 may include a substrate 361 and a light source 362. The substrate 361 may be formed in a plate shape that may be accommodated inside the lower bracket 35 and may extend from one end to the other end of the lower bracket 35. Additionally, a plurality of light sources 362 may be continuously disposed at regular intervals on the substrate 361.

The light source 362 may be disposed to irradiate light toward the lower end of the light guide plate 33. Additionally, the substrate 361 may provide a space where the light source 362 may be continuously disposed from the left end to the other side end of the light guide plate 33. In addition, the left and right ends of the substrate 361 is in contact with the lower bracket side portion 353 inside the lower bracket 35, so that flow in the left and right direction may be restricted.

The light source 362 may be composed of an LED, for example. In addition, the light source 362 may be composed of an RGB LED that may emit light of various colors under the control of the controller 13. In other words, the light source 362 can emit light of various colors under the control of the controller 13, and thus the panel 31 may glow with the color set by the controller 13. In addition, the outer appearance of the front surface color of the door 70 may be determined according to the color of the panel 31.

Meanwhile, the light source 362 may be composed of LEDs that emit light of a specific color in addition to RGB LEDs or may be composed of a combination of multiple LEDs that emit light of different colors. Additionally, the light sources 362 may be mounted on the substrate 361 at regular intervals and may be disposed in an appropriate number so that the panel 31 can glow with a set luminance.

Meanwhile, a light supporter 37 may be provided inside the lower bracket 35. The light supporter 37 may support the lighting device 36 inside the lower bracket 35.

In addition, the light supporter 37 may be formed of a metal material to dissipate heat generated by the lighting device 36 by conduction and may be formed to a size that can be entered and exited through the bracket opening 352*a*.

The light supporter 37 may include a first supporting part 372 that supports the lighting device 36 and a second supporting part 371 in contact with the back cover 39. The first supporting part 372 may be disposed on the lower bracket lower surface portion 354 inside the lower bracket 35. The second supporting part 371 may extend upward from the rear end of the first supporting part 372 and be exposed to the rear through the bracket opening 352*a* to be in contact with the back cover 39 when the back cover 39 is installed. Accordingly, the heat generated from the lighting device 36 may be transferred to the back cover 39 through the light supporter 37 and dissipated.

Meanwhile, a lower decoration 47 may be mounted on the lower bracket 35. The lower decoration 47 is formed along the lower end of the panel assembly 30, may be formed to cover the lower bracket 35 which fixes the lower end of the panel assembly 30 to the door body 40 and is exposed to the lower end of the panel assembly 30 at the same time.

Meanwhile, the refrigerator 1 according to an embodiment of the present disclosure is equipped with other doors 202 and 201*a* in addition to the door 70, and the doors 202 and 201*a* are also equipped with a panel assembly on the front surface of which the color may be changed and thus the color of the outer appearance of the front surface may be changed according to the user's selection.

Hereinafter, the structures of the other doors 202 and 201*a* of the refrigerator 1 will be examined with reference to the drawings and the structures of the other doors 202 and 201*a* are the same except for their sizes and positions, so the structures on the left side of the refrigerator 1 are the same, and thus the description will be based on the refrigerating chamber door 201*a*, and it may be referred to as another door or a non-seeing-through door to distinguish it from the door 70.

Figure 20:
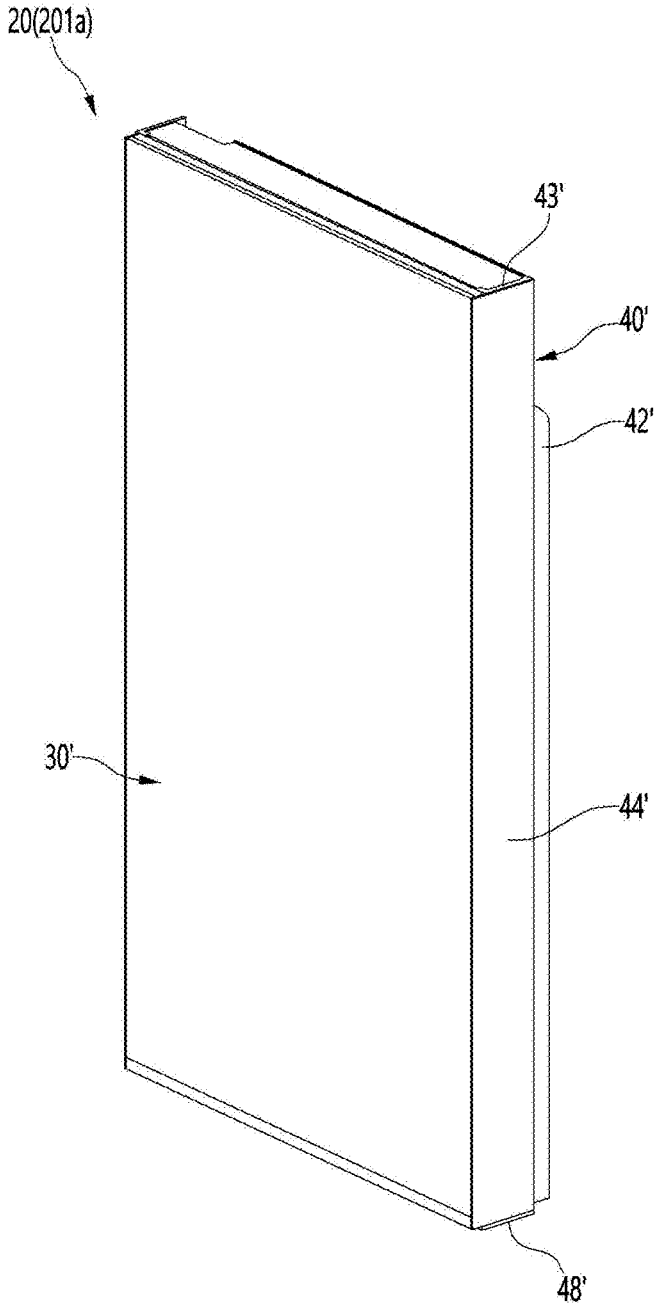
FIG. 20 is a perspective view illustrating another door according to an embodiment of the present disclosure.
Figure 21:
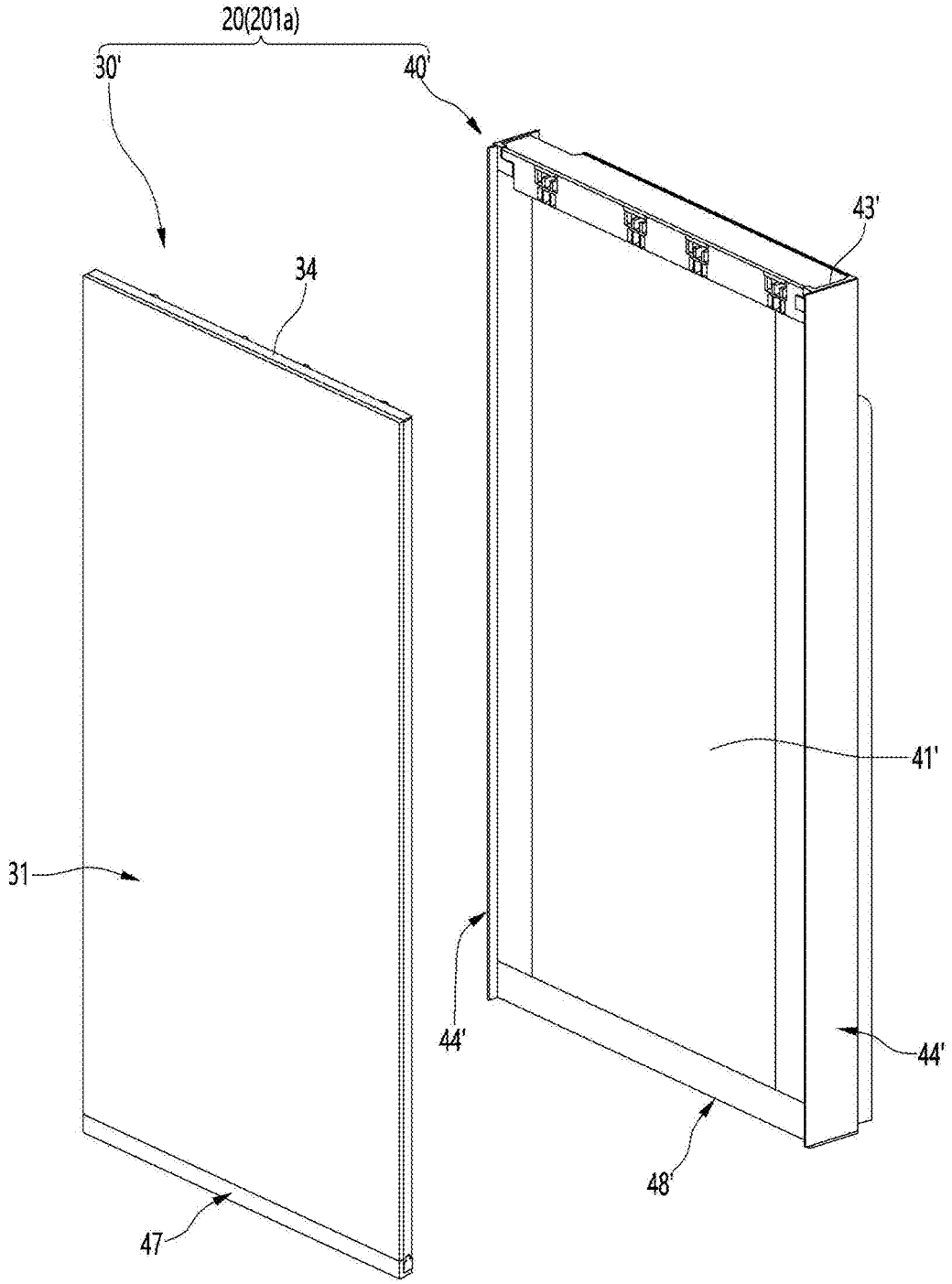
FIG. 21 is an exploded perspective view illustrating a state where the door panel assembly and the door body are separated.
Figure 22:
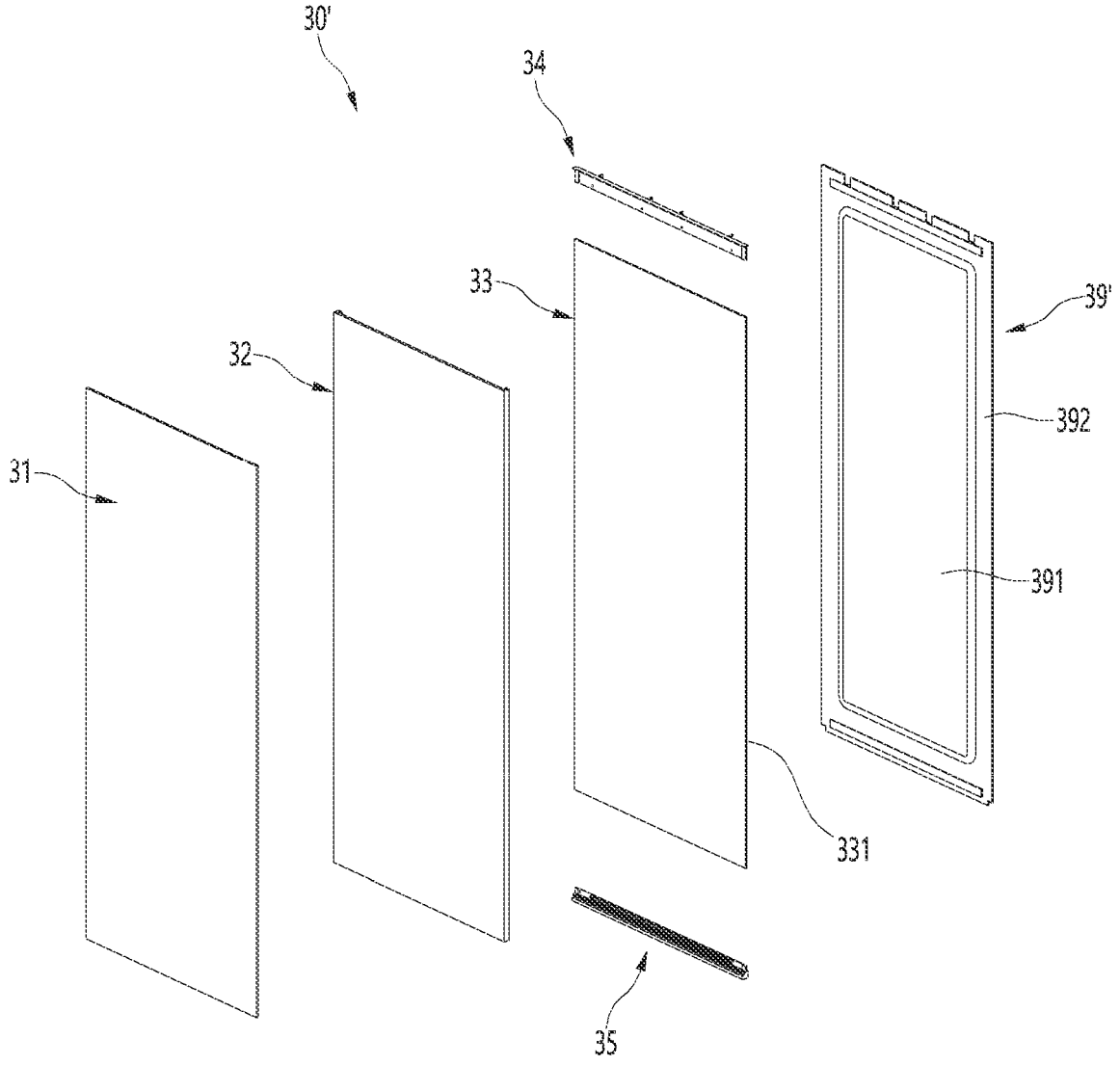
FIG. 22 is an exploded perspective view illustrating the door panel.

FIG. 20 is a perspective view illustrating another door according to an embodiment of the present disclosure, FIG. 21 is an exploded perspective view illustrating a state where the door panel assembly and the door body are separated, and FIG. 22 is an exploded perspective view illustrating the door panel.

Prior to the description, the other door 201*a* of the present disclosure is the same as the door 70 described above except for some components, and the same components are indicated using the same names and reference numerals, and detailed descriptions thereof are omitted.

As illustrated in the drawing, another door 201*a* of the present disclosure may be configured to glow in the same color as the door 70 described above. Accordingly, the front surface of the refrigerator 1 is displayed in the same color as a whole, and may be changed to various colors according to the user's selection.

The other door 201*a* may include a door body 40' rotatably mounted on the cabinet 10 and a panel assembly 30' mounted on the front surface of the door body 40'.

The door body 40' may include a front plate 41' forming a front surface, and a door liner 42' forming a rear spaced apart from the front plate 41'. In addition, it may include an upper cap decoration 43 forming the upper surface and a lower cap decoration 48' that connect between the front plate 41' and the door liner 42'. In addition, the door body 40' may further include side decorations 44 forming both left and right sides. Additionally, the interior of the door body 40' may be filled with an insulating material.

Meanwhile, the front plate 41' may be made of an opaque material, for example, a metal material such as steel or aluminum.

The panel assembly 30' may be mounted in front of the front plate 41'. The panel assembly 30' may be mounted on the door body 40' to form the outer appearance of the front surface of the other door 201*a*.

In detail, the panel assembly 30' may include a panel 31 forming the front surface, a transparent member 32 provided at the rear of the panel 31, a light guide plate 33 mounted on the transparent member 32, an upper bracket 34 and a lower bracket 35 forming the upper and lower surfaces of the panel assembly 30', a lighting device 36 mounted inside the lower bracket 35, and a back cover 39' forming the rear of the panel assembly 30'.

The panel 31 may be mounted on the front surface of the transparent member 32, and the light guide plate 33 may be slidably inserted and mounted on the rear. In addition, the upper bracket 34 and the lower bracket 35 may be inserted and installed at the upper and lower ends of the transparent member 32. At this time, the lighting device 36 is aligned at a position facing the lower end of the light guide plate 33 when the lower bracket 35 is mounted and irradiates light to the lower end of the light guide plate 33.

The light guide plate 33 guides the light emitted from the lighting device 36 toward the front panel 31, and allows the panel 31 to glow brightly by the reflective layer 331 disposed on the rear of the light guide plate 33.

The color of the light emitted from the lighting device 36 may be determined according to the user's manipulation and is emitted forward by the light guide plate 33 and thus passes through the transparent member 32 and then the panel 31 may be displayed in the selected color.

Additionally, the back cover 39' is coupled to the upper bracket 34' and the lower bracket 35' to form the outer appearance of the rear of the panel assembly 30'.

Meanwhile, compared to the panel assembly 30 described above, the only difference is that a reflective layer 331 is further formed on the rear of the light guide plate 33 and the cover opening 39' is not formed in the back cover 39', so the overall structure is the same, so a detailed description thereof is omitted.

Hereinafter, the operation of the refrigerator 1 having the above structure will be examined in more detail with reference to the drawings.

Figure 23:
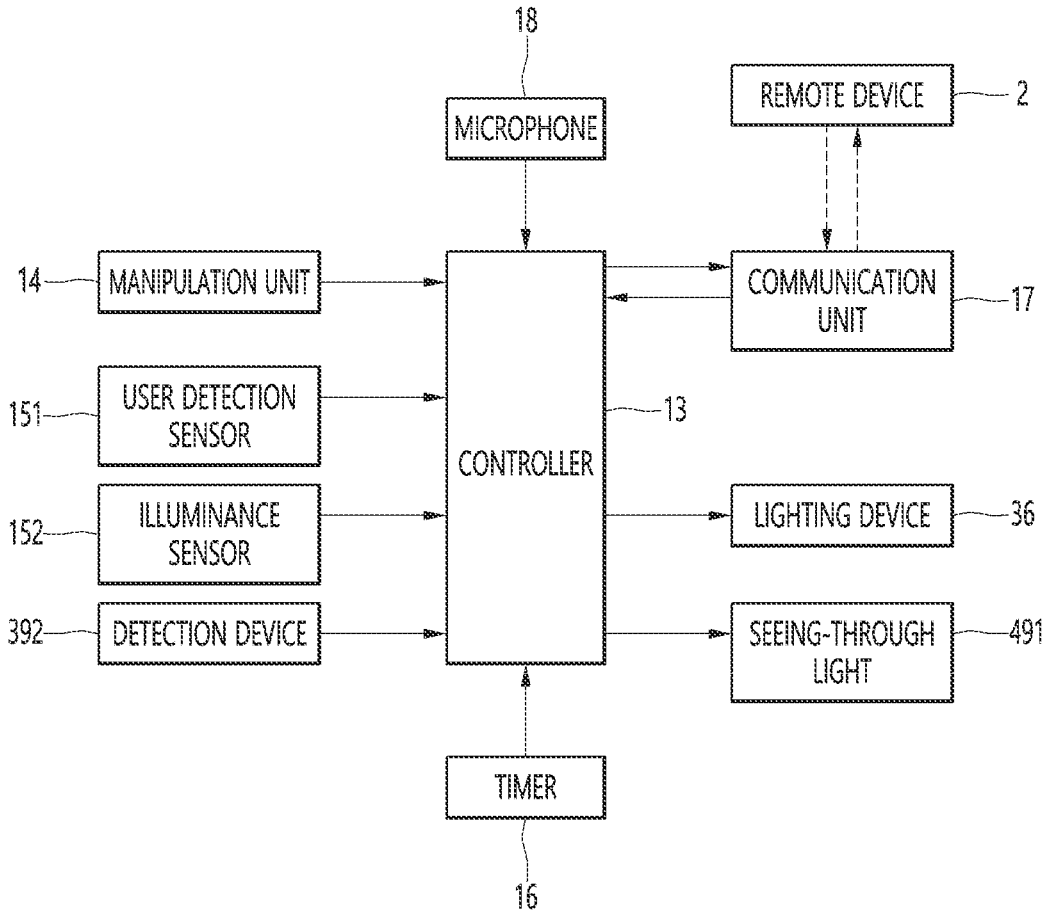
FIG. 23 is a block diagram illustrating the flow of control signals of the refrigerator.
Figure 24:
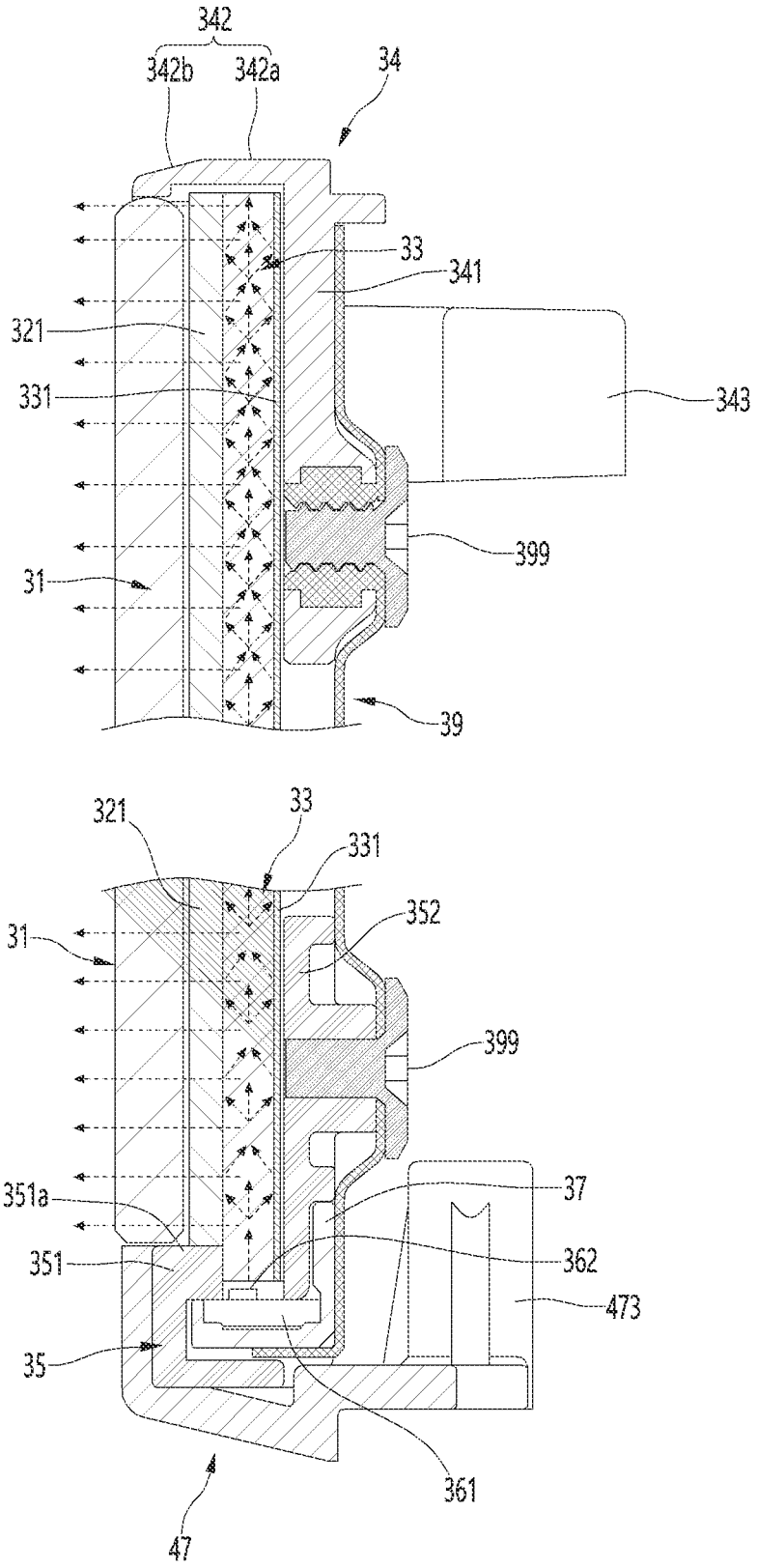
FIG. 24 is a cross-sectional view illustrating the light emitting state of the panel assembly.
Figure 25:
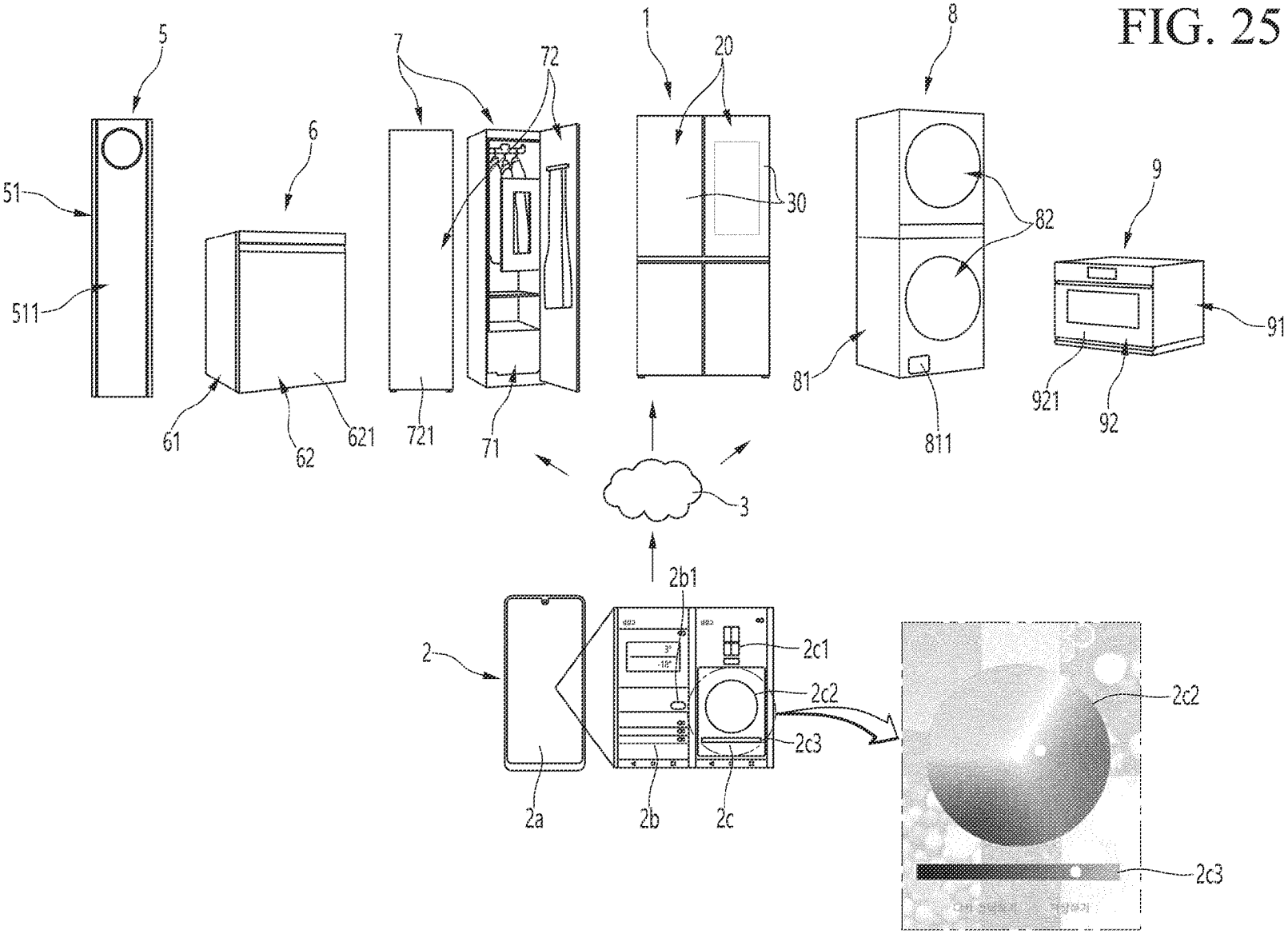
FIG. 25 is a diagram illustrating an example of adjusting the color of home appliances to which the panel assembly is applied using a remote device.
Figure 26:
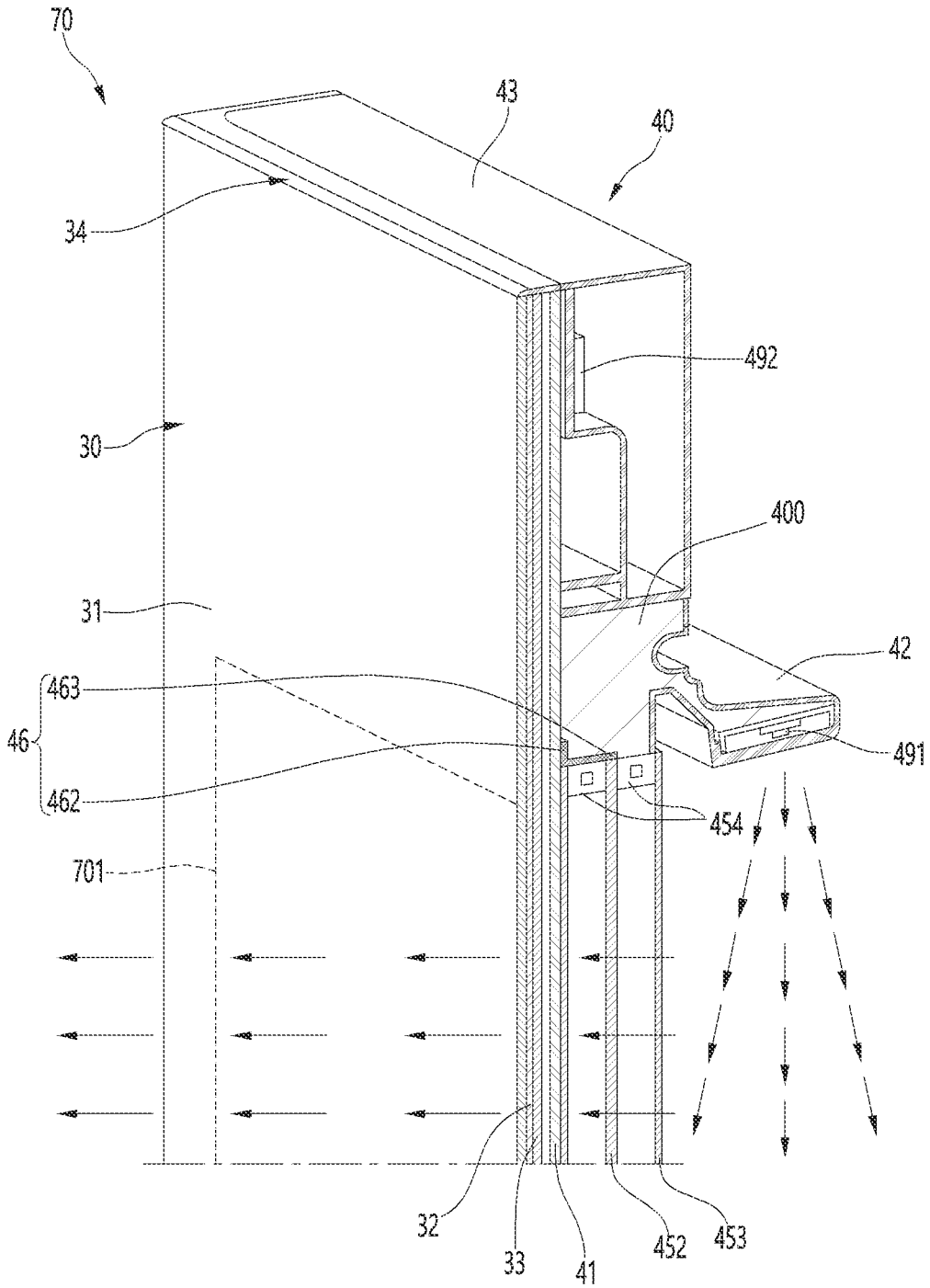
FIG. 26 is a cut-away perspective view illustrating the door in a visible state.

FIG. 23 is a block diagram illustrating the flow of control signals of the refrigerator, FIG. 24 is a cross-sectional view illustrating the light emitting state of the panel assembly, FIG. 25 is a diagram illustrating an example of adjusting the color of home appliances to which the panel assembly is applied using a remote device, and FIG. 26 is a cut-away perspective view illustrating the door in a visible state.

As illustrated in the drawing, the color of the outer appearance of the front surface of the refrigerator 1 according to an embodiment of the present disclosure may be expressed by the color of the panel 31 in a state where the lighting device 36 is turned off. In addition, when the lighting device 36 is turned on, the color of the panel 31 is changed according to the color of the light emitted from the lighting device 36, and the color of the outer appearance of the front surface of the door 20 may be expressed in the selected color. Therefore, the panel assembly 30 or the panel 31 may also be referred to as a screen.

In addition, when the see-through light 491 is turned on, the space behind the door 70 becomes bright, and the space behind the door 70 may be viewed through the see-through region 701 of the door 70.

The home appliance may be any one of a refrigerator 1, an air conditioner 5, a dishwasher 6, a clothes care machine 7, a washing machine 8, or a cooking appliance 9, and by applying the same structure as the panel assembly 30 in the embodiment of the present disclosure, the color of the outer appearance of the front surface may be freely changed.

For example, in the above-described embodiment and the refrigerator 1, the panel assembly 30 may be provided on the front surface of the door 20 that opens and closes the cabinet 10. In addition, according to user settings, the panel assembly 30 may glow in a set color, and the color of the outer appearance of the front surface of the refrigerator 1 may be changed.

As another example, the indoor unit of the air conditioner 5 may have a space provided with a heat exchange device and a fan inside the case 51 (or cabinet) forming the outer appearance. Additionally, the front surface of the case 51 may be formed by a panel assembly 511. The panel assembly 511 has the same structure as the panel assembly 30 of the refrigerator 1 described above and may emit light.

Accordingly, according to user settings, the panel assembly 511 glows in a set color, and the color of the outer appearance of the front surface of the indoor unit of the air conditioner 5 may be changed to the set color.

As another example, the dishwasher 6 may have a space for washing dishes inside the case 61 (or cabinet) that forms the outer appearance. Additionally, the front surface of the case 61 may be opened and closed by a door 62, and the front surface of the door 62 may be formed by a panel assembly 621. The panel assembly 621 has the same structure as the panel assembly 30 of the refrigerator 1 described above and may emit light.

Accordingly, according to user settings, the panel assembly 621 may glow in a set color, and the color of the outer appearance of the front surface of the dishwasher 6 may be changed to the set color.

As another example, the clothes care machine 7 may have a space for storing clothing inside the case 71 (or cabinet) that forms the outer appearance. Additionally, the front surface of the case 71 may be opened and closed by the door 72, and the front surface of the door 72 can be formed by the panel assembly 721. The panel assembly 721 has the same structure as the panel assembly 30 of the refrigerator 1 described above and may emit light.

Accordingly, according to user settings, the panel assembly 721 may glow in a set color, and the color of the outer appearance of the front surface of the clothes care machine 7 may changed to the set color.

As another example, the washing machine 8 or dryer may have a space for washing or drying inside the case 81 (or cabinet) forming the outer appearance. In addition, the front surface of the case 81 may be opened and closed by the door 82. Meanwhile, the front surface of the case 81 may be formed by a panel assembly 811. The panel assembly 811 has the same structure as the panel assembly 30 of the refrigerator 1 described above and may emit light.

Accordingly, according to user settings, the panel assembly 30 glows in a set color, and the color of the outer appearance of the front surface of the washing machine 8 or dryer may be changed to the set color.

As another example, the cooking appliance 9 may have a space for cooking food inside the case 91 (or cabinet) that forms the outer appearance. Additionally, the front surface of the case 91 may be opened and closed by a door 92, and the front surface of the door 92 may be formed by a panel assembly 921. The panel assembly 921 has the same structure as the panel assembly 30 of the refrigerator 1 described above and may emit light.

Accordingly, according to user settings, the panel assembly 921 may glow in a set color, and the color of the outer appearance of the front surface of the cooking appliance 9 may be changed to the set color.

Meanwhile, the following will look at the process of changing the color of the panel assembly 30.

In a state where the lighting device 36 is turned off, the color of the outer appearance of the front surface may be expressed by the color of the panel 31. The color displayed on the panel 31 in a state where the lighting device 36 is turned off may be referred to as the first color.

When the lighting device 36 is operated, the color of the panel 31 changes according to the color of the light emitted from the lighting device 36, and the color of the outer appearance of the front surface of the door 20 may be expressed in the selected color. At this time, the color of the light emitted from the lighting device 36 may be referred to as a second color, and the color of the panel that changes when the lighting device 36 is turned on may be referred to as a third color.

The second color may be different from the third color, and the third color of the panel 31 selected by the user may be implemented by a second color corrected in consideration of the first color of the panel 31 itself. In other words, the light of the second color emitted from the lighting device 36 may be determined by the controller 13 in consideration of the first color of the panel 31 itself, and while the light of the second color transmits through the first color panel, the panel 31 is finally displayed in the third color selected by the user.

In detail, the color of the panel 31 may be determined by selective operation of the lighting device 36. As an example, the lighting device 36 may be operated and set through a remote device 2 separate from the refrigerator 1. The refrigerator 1 may communicate with the remote device 2 through a communication unit 17 connected to the controller 13, and the user manipulates the operation of the lighting device 36 through the remote device 2.

The communication unit 17 may communicate with the remote device 2 in various ways. As an example, the communication unit 17 may have a structure capable of communicating in at least one of wired, wireless, and short-range communication (Bluetooth, Wi-Fi, Zigbee, NFC, or the like). Additionally, the remote device 2 may be a variety of devices capable of communication, such as a dedicated terminal, mobile phone, tablet, portable PC, desktop PC, remote control, or Bluetooth speaker.

The user may manipulate and set the overall operating state of the lighting device 36, such as the operating time, operating conditions, and color of the light emitted from the light source of the lighting device 36, through the manipulation of the remote device 2. For example, simple manipulation and setting of the lighting device 36 may be possible through an application or dedicated program installed on the user's mobile phone.

Selection of the changing color of the panel 31 through the remote device 2 will be examined with reference to FIG. 25. The user may select the color of the desired panel 31 through the screen 2*a* of the remote device 2, such as a mobile phone or terminal.

When the user manipulates the remote device 2, the remote device first outputs the menu screen 2*b* and manipulates the panel color change menu 2*b*1 through the menu screen 2*b*.

When the user selects the panel color change menu 2*b*1, the remote device 2 outputs a color selection screen 2*c* on the menu screen 2*b*, and the user may select the position of the panel 31 to be changed and the color of the panel 31 to be changed on the color selection screen.

In detail, a panel position selection menu 2*c*1 is displayed on the color selection screen 2*c* so that the panel 31 mounted on the door 20 at a desired position among the plurality of doors 20 may be selected. Additionally, the panel 31 of the door 20 selected by the user may be displayed in the panel position selection menu 2*c*1.

After selecting the desired location of the panel 31, the user may select and input the color selection menus 2*c*2 and 2*c*3 displayed on the color selection screen 2*c*. For example, the color selection menus 2*c*2 and 2*c*3 may display all colors that the panel 31 can display in the form of a color picker capable of checking and extracting color codes. The color selection menu 2*c*2 and 2*c*3 may be referred to as a palette because it allows combination and selection of various colors.

The color selection menus 2*c*2 and 2*c*3 may include a circular first selection part 2*c*2 and a bar-shaped second selection part 2*c*3. A color may be selected in the first selection part 2*c*2, and the exposure (intensity) of the selected color may be selected in the second selection part 2*c*3. The color selection menus 2*c*2 and 2*c*3 may be composed of either the first selection part 2*c*2 or the second selection part 2*c*3.

In this way, the user may select the color of the panel 31, that is, the third color, from among various colors through the color selection menus 2*c*2 and 2*c*3. Of course, the color selection menus 2*c*2 and 2*c*3 may be configured to allow input in the form of character codes, numbers, or the like.

In addition, according to the user's selection of the third color, the controller 13 controls the lighting device 36 to turn on the second color so that the panel 31 may be displayed in the third color.

Additionally, the user may input a color through the manipulation unit 14 provided in the refrigerator 1 without using the remote device 2.

Additionally, the refrigerator 1 and the remote device 2 may be connected to a server in a network state, and therefore, the color of the panel 31 of the refrigerator 1 may be input through the server 3.

Meanwhile, the operation of the lighting device 36 may be performed through the user's manipulation of the manipulation unit 14. The manipulation unit 14 may be provided on one side of the refrigerator 1, and for example, may be provided on one side of the cabinet 10. Of course, the manipulation unit 14 may be provided on the door 20 as needed, and input may be performed by manipulation such as touching or knocking on the panel 31. In other words, the user can set the operation of the lighting device 36 by directly manipulating the manipulation unit 14 and may also turn the lighting device 36 on or off.

Additionally, the lighting device 36 may be operated by a sensor. For example, the sensor may be a user detection sensor 151 that detects the user's proximity. For example, the user detection sensor 151 may be an infrared sensor, an ultrasonic sensor, a laser sensor, or other devices that may detect the user's proximity to the refrigerator.

Additionally, the user detection sensor 151 may be provided on one side of the cabinet 10 or the door 20, and may be placed in various positions to detect the proximity of a user. Additionally, a plurality of sensors may be provided at different locations.

Therefore, when the user approaches the refrigerator 1 by a set distance to use the refrigerator 1, the user detection sensor 151 may detect this, transmit a signal to the controller 13, and turn on the lighting device. 36. In addition, when the user moves away from the refrigerator 1, the user detection sensor 151 can detect this and transmit a signal to the controller 13 to turn off the lighting device 36.

In detail, when the user detection sensor 151 detects that the user is very close to the refrigerator 1, the lighting device 36 may be turned off or the brightness may be gradually dimmed to prevent dazzling the user. In addition, when the user moves away from the refrigerator 1 again, the lighting device 36 may be turned on again or returned to the original brightness thereof.

The sensor may be an illuminance sensor 152. The illuminance sensor 152 detects the illuminance of an indoor space and may be placed at the same location as the user detection sensor 151.

Additionally, the lighting device 36 may be operated according to the illuminance detected by the illuminance sensor 152. For example, when the illuminance detected by the illuminance sensor 152 becomes the set illuminance or less and it becomes dark, the controller 13 turns on the lighting device 36, and the illuminance detected by the illuminance sensor 152 is set to the set illuminance or more and it becomes brighter, the controller 13 may turn off the lighting device 36.

Meanwhile, the sensor may include both the illuminance sensor 152 and the user detection sensor 151, and the illuminance sensor 152 and the user detection sensor 151 operate in a complex manner and thus the lighting device 36 may be controlled to turn on and off by the controller 13.

Additionally, the controller 13 may be connected to the microphone 18. Therefore, the light source 362 may be made to glow in a set color according to the voice signal received from the microphone 18, and the input state of the voice signal or the setting state of the function may be displayed through the front color of the door 20.

For example, when a user's temperature adjustment signal is input through the microphone 18, the controller 13 adjusts the temperature inside the refrigerator to a set temperature and may operate the lighting device 36 so that color of the front surface of the door 20 is changed to a color corresponding to the temperature.

Meanwhile, the lighting device 36 may be turned on and off at a time set by the timer 16. In other words, the lighting device 36 may be turned on according to the time when the user is mainly active, and remain off outside of the set time range. Additionally, the lighting device 36 may be turned off during the day and turned on at night regardless of the actual illuminance.

In addition, regardless of the operating state of the refrigerator 1, the brightness and color of the front surface of the door 20 may be adjusted only according to the user's settings.

Additionally, the lighting device 36 may include a brightness-adjusted state in addition to the on state and the off state. In other words, the controller 13 may vary the brightness of the panel 31 by adjusting the output of light emitted through the lighting device 36. Additionally, the operating state of the refrigerator 1 may be indicated through the brightness of the panel 31.

Meanwhile, looking at the operating state of the lighting device 36 operated by the controller 13, as illustrated in FIG. 24, when the lighting device 36 is turned on according to the instructions of the controller 13, light emitted from the light source 362 may be emitted toward the lower end of the light guide plate 33. At this time, the light emitted from the light source 362 may be emitted in a second color selected by the controller 13. In other words, the light source 362 is an RGB LED and emits light of the second color corrected by the controller 13 so that the surface of the panel 31 glows in the third color selected by the user.

Light incident through the lower end of the light guide plate 33 may be diffused and reflected along the light guide plate 33 and may move along the light guide plate 33. At this time, the light guided by the light guide plate 33 may be reflected forward by the reflective layer 331 and transmitted to the outside through the panel 31.

Light heading forward through the light guide plate 33 passes through the transparent member 32 to illuminate the panel 31, and the front surface of the door 20 may glow with a set brightness or color.

At this time, not only the door 70 but also other doors 202 and 201*a* may display the color of the front surface of the door 70 by glowing with a set color.

Meanwhile, looking at the visualization state of the door 70 according to the operation of the see-through light 491, as illustrated in FIG. 26, the see-through light 491 is turned on according to the instruction of the controller 13, the light emitted from the see-through light 491 may emit to brighten the space behind the door.

In detail, the user may knock on the front surface of the door 70, that is, the front surface of the panel 31, and the detection device 492 may detect the user's knock and transmit a signal to the controller 13. Of course, if necessary, the sensing device 492 may be composed of a proximity sensor, a camera, a microphone 18, or the like, and the see-through light 491 may be turned on and off in various ways.

The controller 13 may turn on the see-through light 491 according to an input signal, and the see-through light 491 may brighten the space behind the door 70. When the space behind the door 70 becomes bright, the space behind the door may be visualized by the seeing-through assembly 45.

As an example, the see-through light 491 emits light from above to below the liner opening 421 and may brighten the inner space of the opening 61. Therefore, food stored in the opening 61 or the rear of the door 70 may be visualized, and the user may check the inside even without opening the door 70. In other words, a user standing in front of the door 70 may see the space behind the door through the panel assembly 30, the front plate 41, and the seeing-through assembly 45.

Meanwhile, the see-through light 491 may be turned off by the user knocking on the front surface of the door 70 again. Additionally, the seeing-through light 491 may be turned on and then turned off when the timer 16 determines that the set time has elapsed.

Hereinafter, changes in the outer appearance of the front surface of the door 20 according to the operation of the lighting device 36 and the see-through light 491 will be examined with reference to the drawings.

Figure 27:
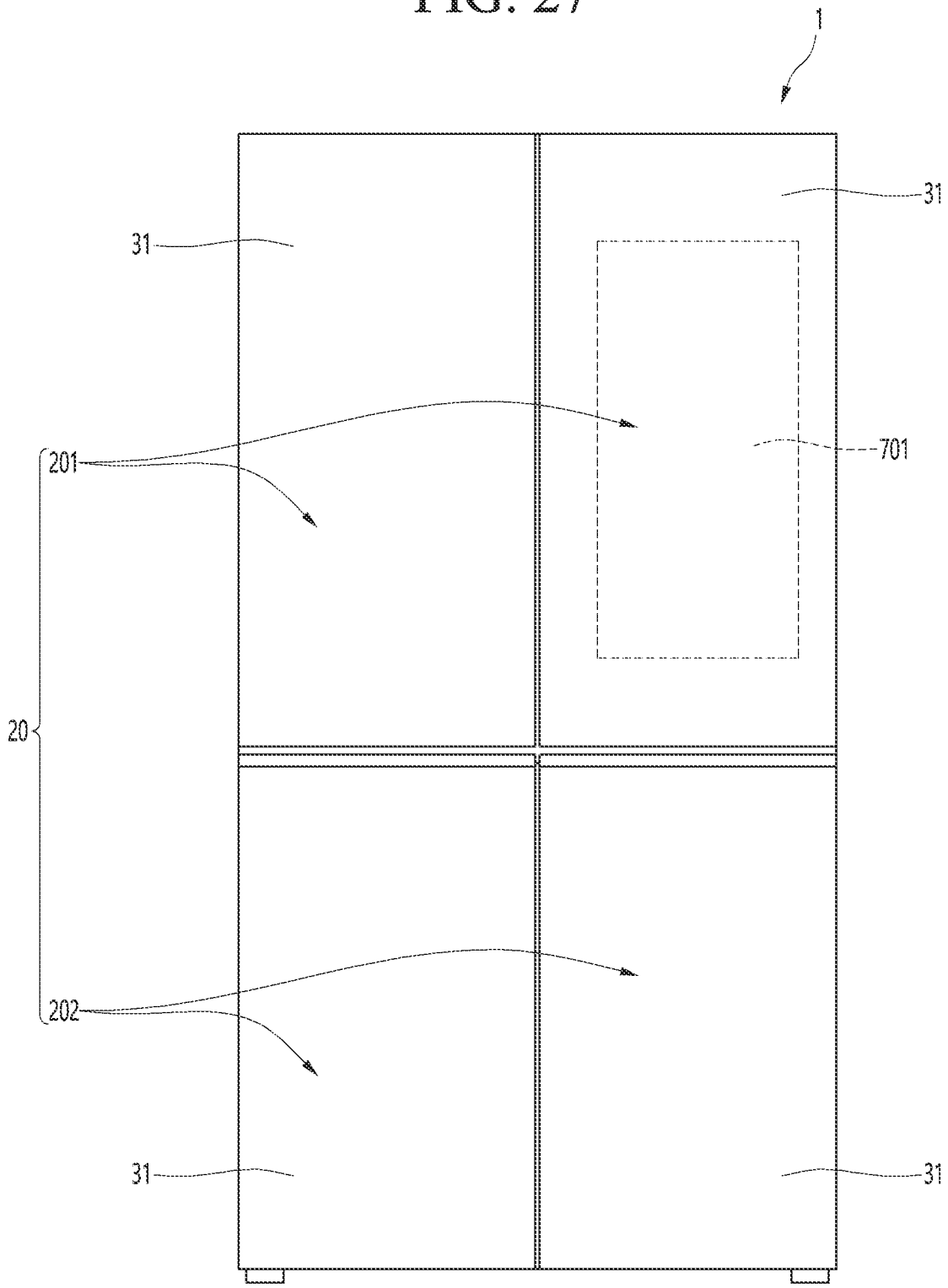
FIG. 27 is a front view illustrating the outer appearance of the front surface of the refrigerator with the lighting device turned off.
Figure 28:
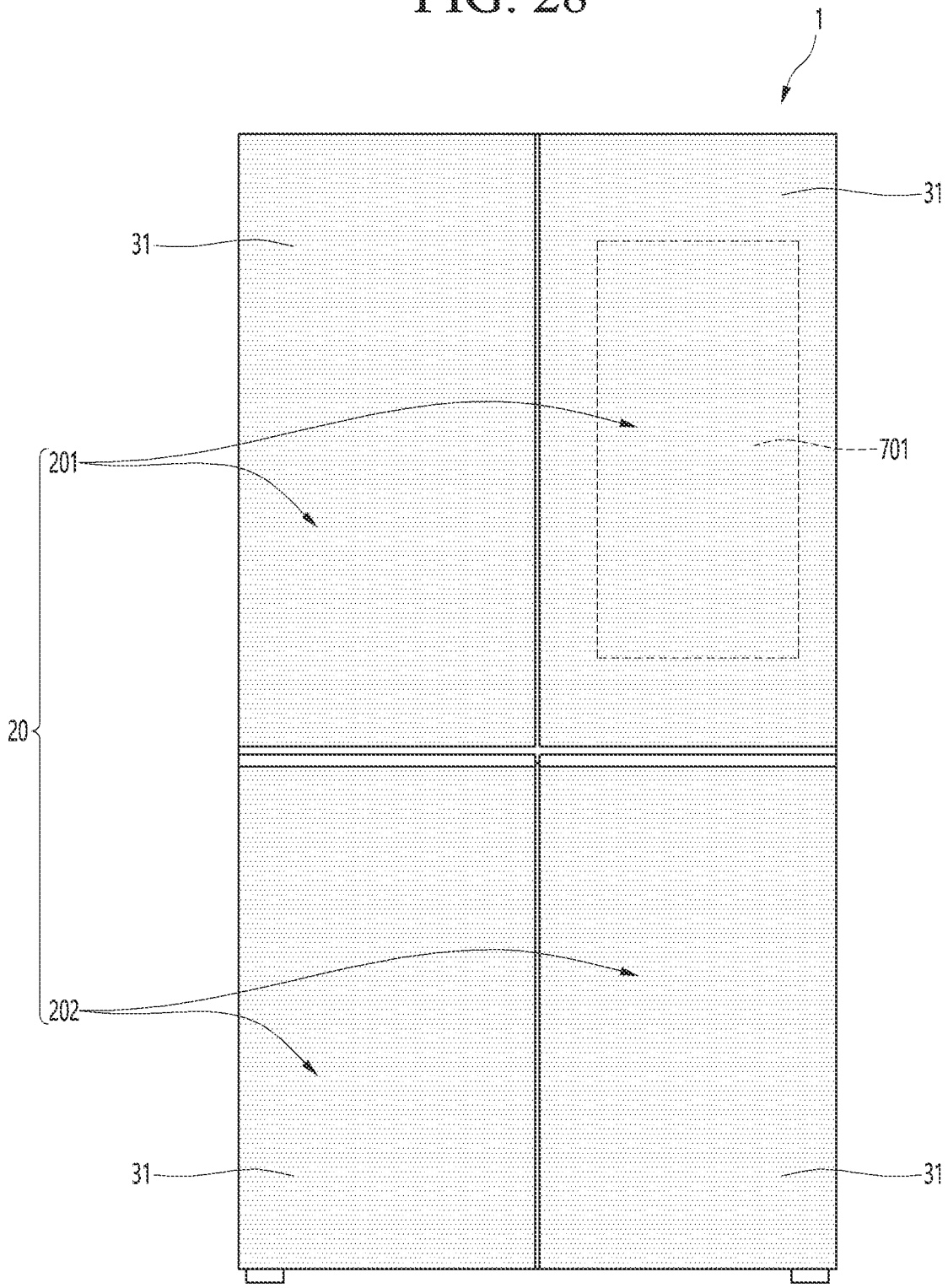
Figure 29:
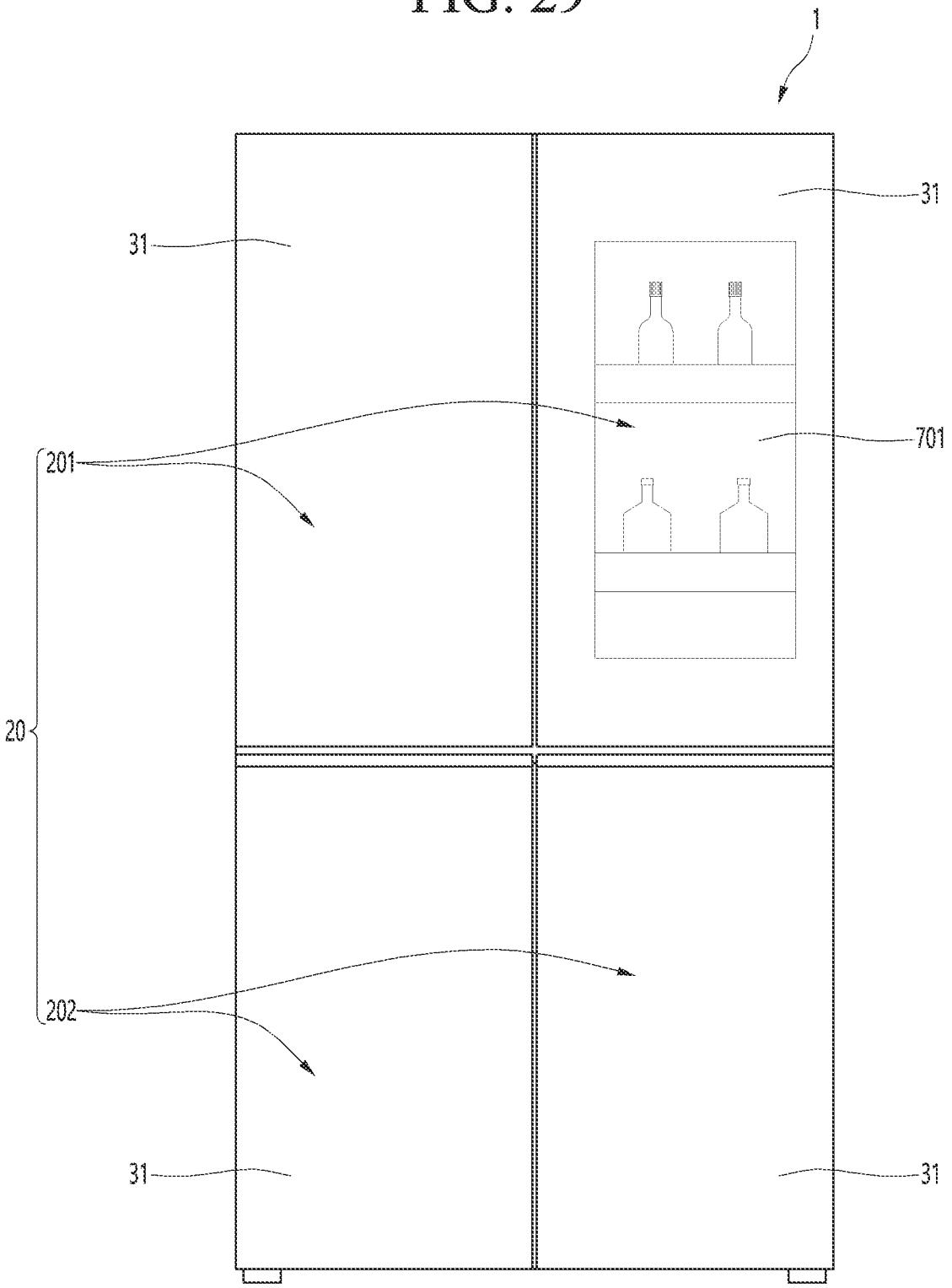
Figure 30:
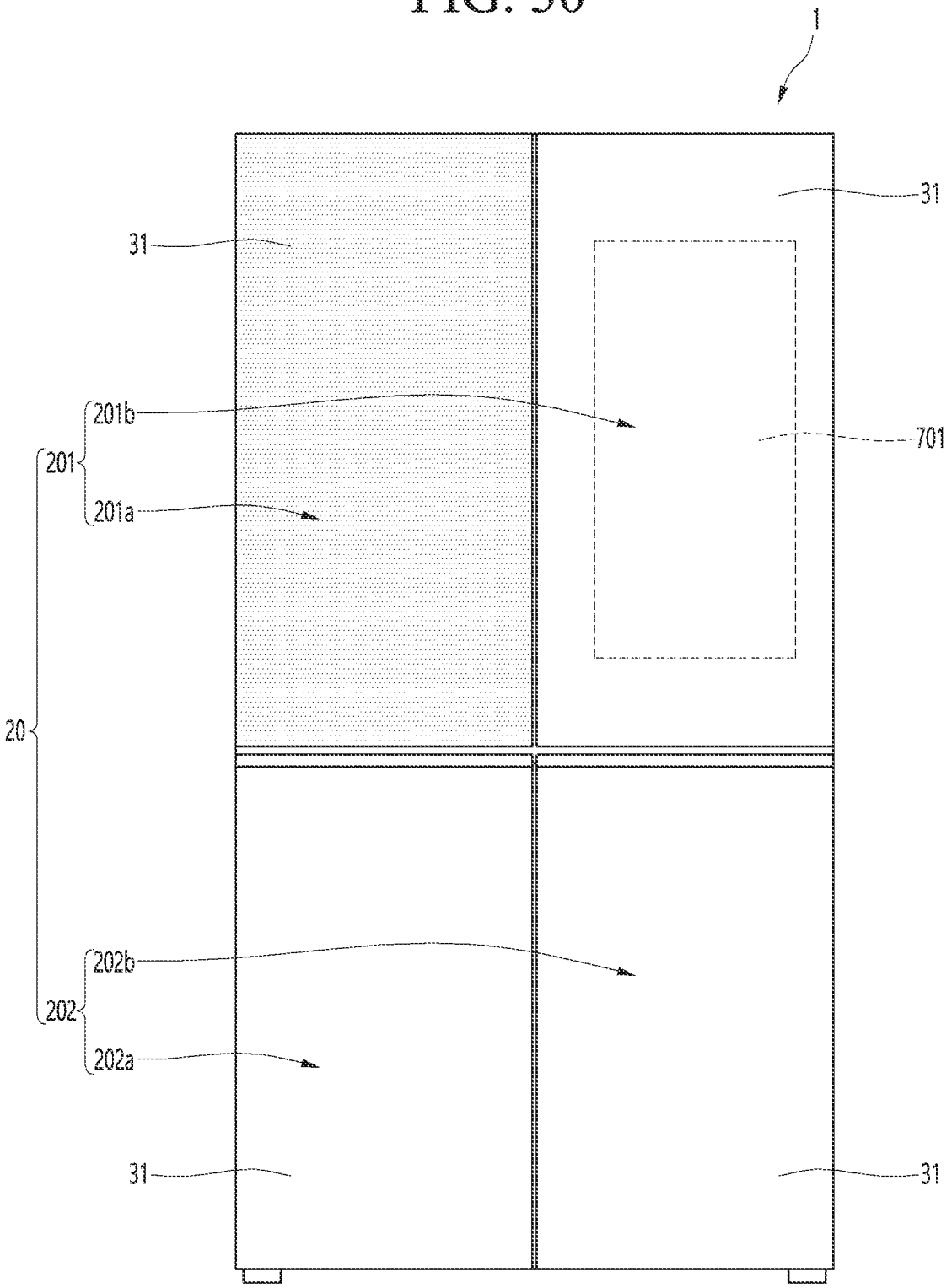
FIG. 30 is a front view illustrating the outer appearance of the front surface of the refrigerator with some of a plurality of doors emitting light.
Figure 31:
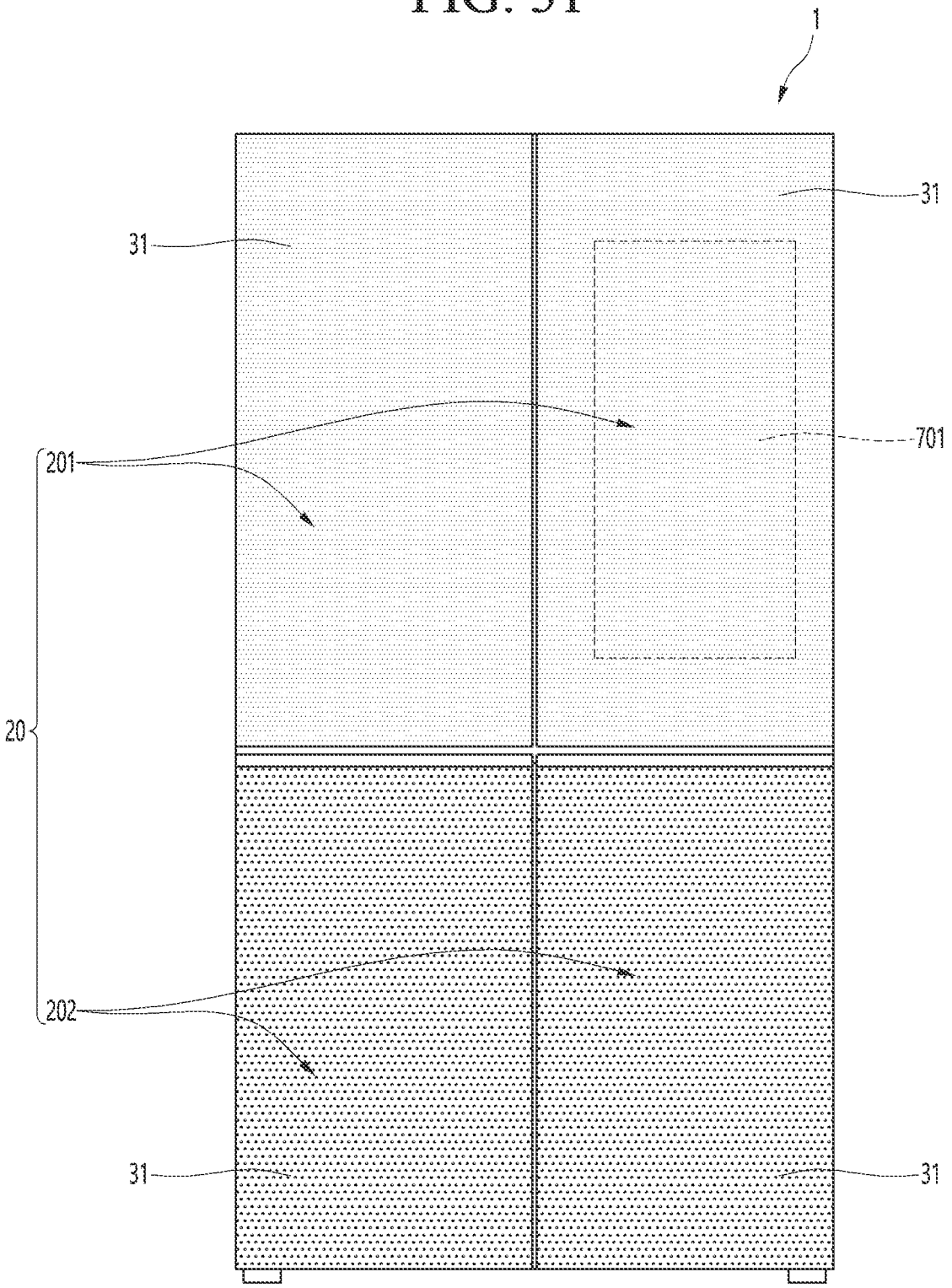
FIG. 31 is a front view illustrating the outer appearance of the front surface of the refrigerator with the refrigerating chamber door and the freezing chamber door of the doors each emitting light.

FIG. 27 is a front view illustrating the outer appearance of the front surface of the refrigerator with the lighting device turned off, FIG. 28 is a front view illustrating the outer appearance of the front surface of the refrigerator with the lighting device turned on, FIG. 29 is a front view illustrating the outer appearance of the front surface of the refrigerator with the seeing-through light turned on, FIG. 30 is a front view illustrating the outer appearance of the front surface of the refrigerator with some of a plurality of doors emitting light, and FIG. 31 is a front view illustrating the outer appearance of the front surface of the refrigerator with the refrigerating chamber door and the freezing chamber door of the doors each emitting light.

In a state where the lighting device 36 is turned off, as illustrated in FIG. 26, the front surface of the door 20 does not glow, and the original color of the panel assembly 30, that is, the first color, appears.

The panel assembly 30 has a structure that may be separated from the door body 40, so the user may select the initial color of the panel 31 by mounting the panel assembly 30 of the desired color. Of course, if necessary, the user may change the color of the panel 31 when the lighting device 36 is turned off by replacing the panel assembly 30 itself.

The front color of the door 20 may be seen as the color of the panel 31, and the texture and pattern formed on the panel 31 may be visible. At this time, the color of the panel 31 may have a brightness greater than 0 and may be a color other than black.

Accordingly, the front surface of the door 20 is displayed in the first color, which is the color of the panel 31. At this time, the internal components of the panel assembly 30 are seen through according to the color of the panel 31 and becomes invisible to the outside.

In addition, when the user does not manipulate the door 70 to check the space behind the door 70, the see-through light 491 remains in an off state. When the see-through light 491 is turned off, the space behind the door 70 is not visible, and the rear components of the panel assembly 30 may also be invisible.

Accordingly, the front surface of the door 70 may be expressed in outer appearance by the color of the panel 31, and the entire door 70 may be seen in the first color. At this time, the entire front surface of the door 70 is displayed in the first color, and therefore the seeing-through region 701 is not visible to the outside, and it may appear as if the seeing-through region 701 is not formed, and may have the same outer appearance as the other doors 202 and 201*a*.

Of course, in addition to the door 70, the lighting device 36 may be turned off so that the outer appearances of other doors 202 and 201*a* may be expressed by the color of the panel 31, and, for example, the outer appearance of the doors 202 and 201*a* may be expressed by the first color of the panel 31, which is the same as the door 70. In other words, the door 70 and the other doors 202 and 201*a* may all appear to have the same outer appearance color.

In this state, the lighting device 36 may be turned on, and when the lighting device 36 is turned on, the front surface of the door 20 lights up in a color selected by the user.

For example, as illustrated in FIG. 28, the controller 13 may control the front surface of the door 20 to glow in a third color different from the first color, and the lighting device 36 may cause the light source 362 to glow in a second color under the control of the controller 13. At this time, the third color may be selected by the user, and the color of the panel 31 may be selected by manipulating the remote device 2 or the manipulation unit 14.

When the light source 362 glows with the second color, the light reflected by the light guide plate 33 passes through the front surface of the panel 31, and the front surface of the door 20, that is, the panel 31, may be displayed in third color.

Meanwhile, when the controller 13 instructs to change the color of the light emitted from the lighting device 36 while the outer appearance of the front surface of the refrigerator 1 glows in a third color, the panel 31 glows in a different color reset by the controller 13.

For example, the controller 13 may instruct the panel 31 to glow in a fourth color different from the first and third colors, and the lighting device 36 causes the light source 362 to emit light of different colors according to instructions from the controller 13.

When the light source 362 glows in a different color, the light reflected by the light guide plate 33 passes through the panel 31, and the front surface of the door 20, that is, the panel 31 may be displayed in the fourth color.

Meanwhile, the panel 31 constituting some of the doors 20 of the plurality of doors 20 forming the outer appearance of the front surface of the refrigerator 1 emits light, or the panel 31 constituting the plurality of doors 20 emits light independently to form the outer appearance of the front surface of the refrigerator 1 in a set color.

Meanwhile, when the user knocks on the door 70 to view the space behind the door 70, the seeing-through region can be visualized as illustrated in FIG. 29.

In detail, when a user's manipulation signal is input, the see-through light 491 is turned on to illuminate the space behind the door 70. When the space behind the door 70 is brightened, even in a state where the door 70 is closed, the space behind the door 70 may be visualized through the transparent assembly 45, the front plate 41, and the panel assembly 30, and the storage state of food may be confirmed without opening the door 70.

In this state, the user can check the space behind the door 70 and then take out or store food.

Meanwhile, in order to visualize the rear of the door 70, in a state where the see-through light 491 is turned on, the lighting device 36 may be turned off or operated to be somewhat dark. In other words, the relatively brighter the space behind the door 70 appears, the easier it is to identify the interior, so the visualization effect through the seeing-through region 701 may be further increased by turning off the lighting device 36 or lowering the brightness. Of course, it may be possible for the see-through light 491 to be turned on in a state where the lighting device 36 is turned on.

In addition, in a state where the other doors 202 and 201*a* glow with a set color by turning on the lighting device 36, only the door 70 has the lighting device 36 turned off and the see-through light 491 turned on and thus it may also be possible to visualize the space behind the door 70. At this time, the lighting device 36 of the door 70 may not be turned off and may glow with a relatively darker brightness compared to the other doors 202 and 201*a* or the space behind the door 70.

For example, as illustrated in FIG. 29, the refrigerator 1 may be operated so that the panel 31 of some doors 201*a* among the plurality of doors 20 glows or glows in a specific color. In other words, not all of the lighting devices 36 provided on the doors 20 are operated, but only some doors 201*a* of all the doors 20 may be configured to glows. As an example, one of the refrigerating chamber doors 201 (201*a*) may glow. In other words, among the left refrigerating chamber door 201*a* and the right refrigerating chamber door 201*b*, the left refrigerating chamber door 201*a* may glow. Of course, the door 20 may be illuminated by any one of the freezing chamber doors 202.

If necessary, the left refrigerating chamber door 201*a* and the door 70 may glow in different colors. Additionally, in a state where the left refrigerating chamber door 201*a* is turned on, the seeing-through region 701 of the door 70 may be selectively visible. Additionally, at least two of the doors 20 may sequentially change color, and at least two of the doors 20 may sequentially turn on and off.

Meanwhile, among the doors, the refrigerating chamber door 20 or the freezing chamber door 20 may be controlled to glow in different colors.

As an example, as illustrated in FIG. 31, the controller 13 may control the lighting device 36 so that the panels of the pair of refrigerating chamber doors 201 appear in one color. Additionally, the controller 13 may control the lighting device 36 so that the pair of refrigerating chamber doors 201 appear in different colors.

In other words, the refrigerating chamber door 201 and the freezing chamber door 202 may be distinguished by color, and the colors of the refrigerating chamber door 201 and the freezing chamber door 202 may also be changed according to changes in temperature inside the refrigerator.

Accordingly, the user can intuitively determine the operation state of each storage space as well as the distinction between the refrigerating chamber and the freezing chamber through the front color of the door 20.

Meanwhile, various other embodiments of the present disclosure may be possible in addition to the above-described embodiments. Another embodiment of the present disclosure is characterized in that the storage space is divided into left and right sides, and the door is composed of a refrigerating chamber door and a freezing chamber door on both left and right sides. Another embodiment of the present disclosure has the same structure as the above-described embodiment except for the disposition of the storage space and the door, and the same reference numerals are used for the same components and detailed description thereof will be omitted.

Hereinafter, another embodiment of the present disclosure will be discussed with reference to the drawings.

Figure 32:
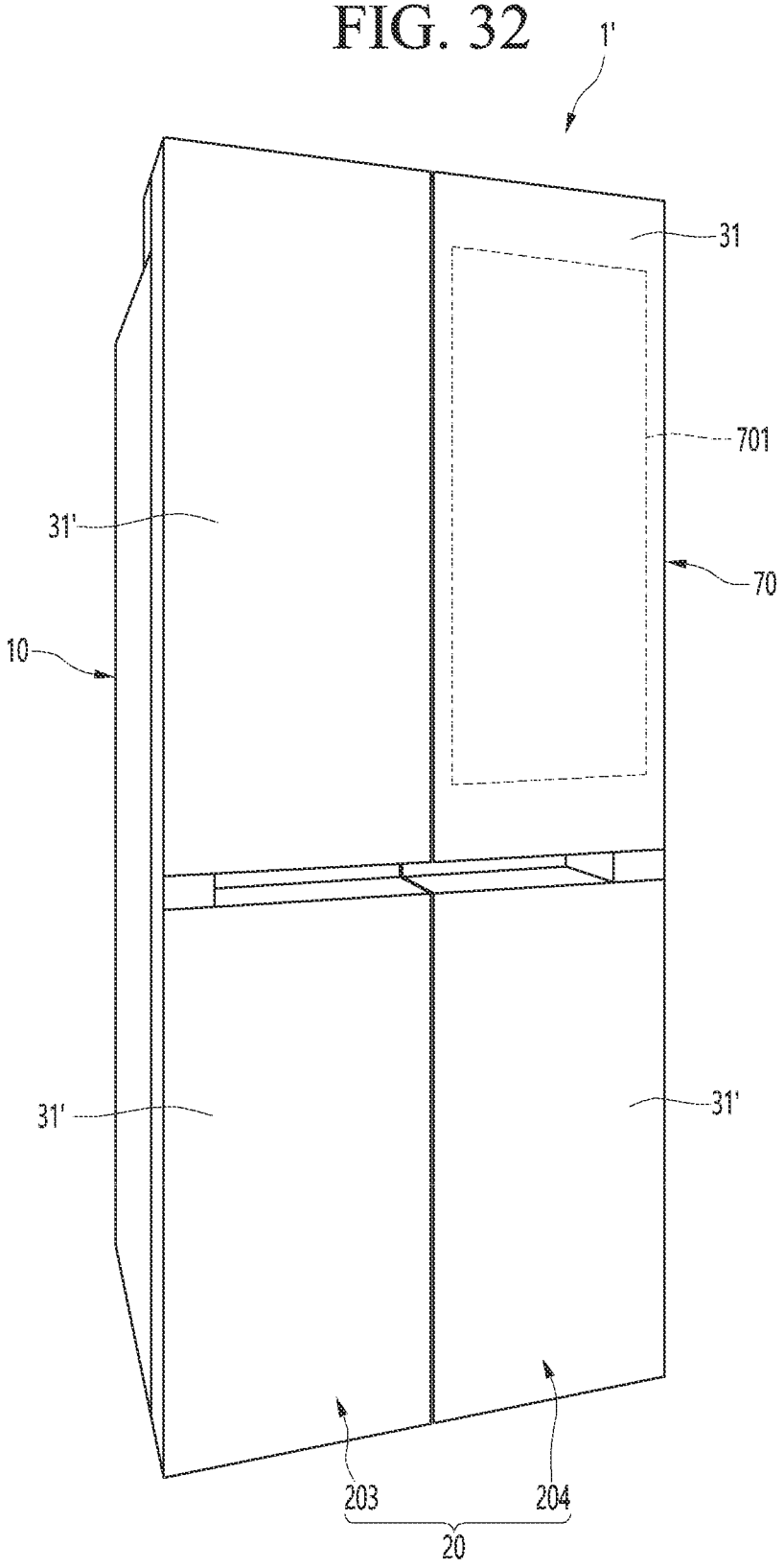
FIG. 32 is a perspective view illustrating a refrigerator according to another embodiment of the present disclosure.
Figure 33:
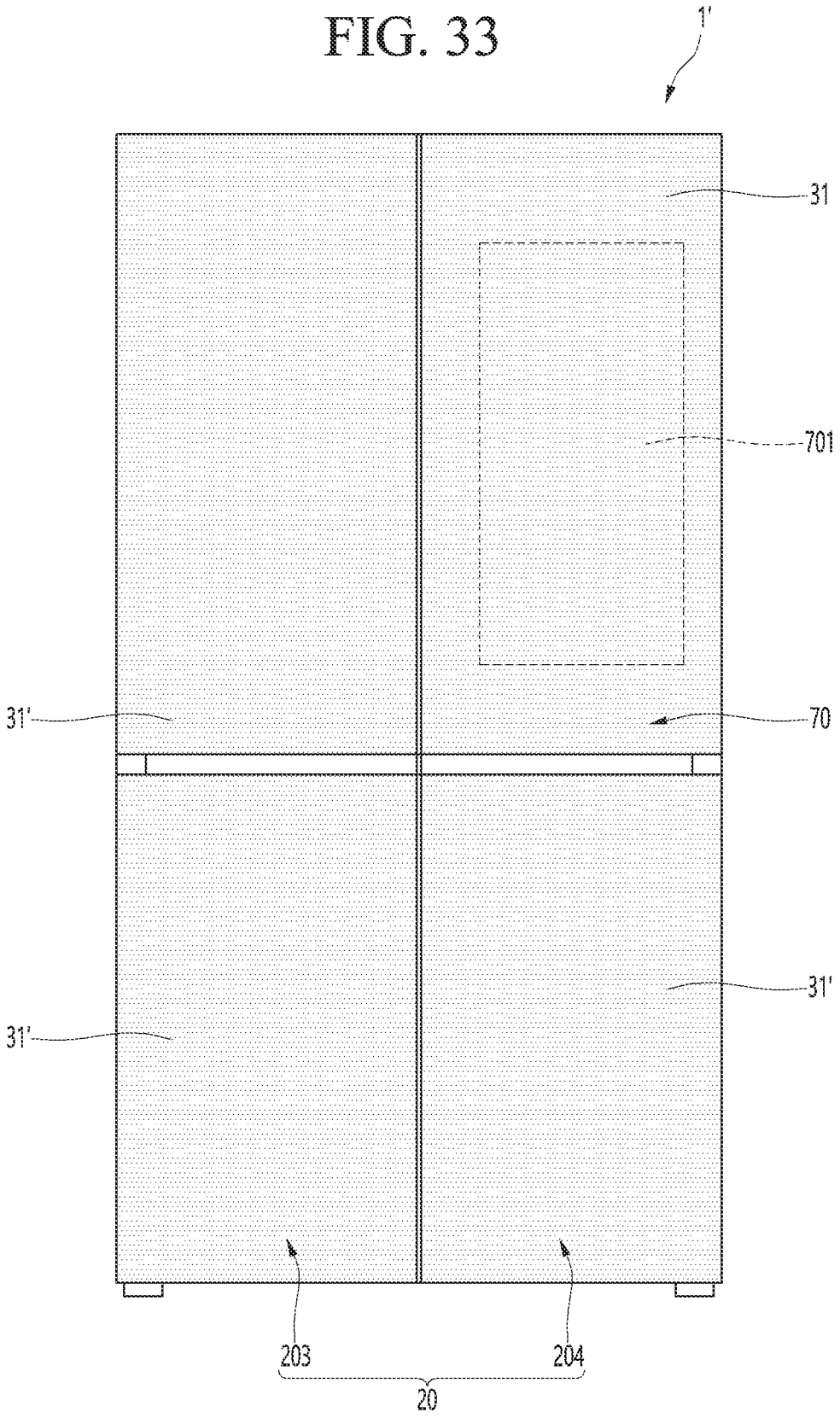

FIG. 32 is a perspective view illustrating a refrigerator according to another embodiment of the present disclosure, and FIG. 33 is a front view illustrating the outer appearance of the front surface of the refrigerator when the lighting device of the refrigerator is turned on.

As illustrated in the drawing, the outer appearance of a refrigerator 1' according to another embodiment of the present disclosure may be formed by a cabinet 10 in which a storage space is formed, and a door 20' that opens and closes the open front surface of the cabinet 10.

The cabinet 10' may be divided into left and right sides. Although not illustrated in detail, the space on the left side of the cabinet 10' may be configured as a freezing chamber, and the space on the right side of the cabinet 10' may be configured as a refrigerating chamber.

Additionally, the door 20' may include a freezing chamber door 203 that opens and closes the freezing chamber and a refrigerating chamber door 204 that opens and closes the refrigerating chamber. The freezing chamber door 203 and the refrigerating chamber door 204 may be disposed side by side on both left and right sides and may be configured to open and close the refrigerating chamber and the freezing chamber, respectively, by rotation.

Meanwhile, an opening may be formed in the upper portion of the refrigerating chamber door 204 like the main door 60 in the above-described embodiment, and a seeing-through door 70 may be further provided to cover the opening. The seeing-through door 70 may be rotatably mounted on the refrigerating chamber door 204 and, in a closed state, is positioned on the same plane as the lower portion of the freezing chamber door 203 and the refrigerating chamber door 204 to provide a sense of unity.

Additionally, the seeing-through door 70 may be provided with a seeing-through region 701, and the rear space of the seeing-through door 70 may be selectively viewed through the seeing-through region 701. The structure and shape of the seeing-through door 70 are the same as those of the above-described embodiment, and therefore detailed description thereof will be omitted.

In a state where the door 20' is closed, the outer appearance of the front surface of the refrigerator 1' may be formed by the door 20'. The door 20' may include a door body 40 and a panel assembly 30". The specific structure of the door 20' is the same as the above-described embodiment, and the only difference is its size and disposition position, so detailed description and illustration thereof are omitted, and reference numerals not illustrated may refer to the above-described embodiment.

The color of the panel assembly 30" may be determined by the panel 31 constituting the front surface of the panel assembly 30". Accordingly, when the lighting device 36 is turned off, the outer appearance of the front surface of the refrigerator 1' may be formed by the color of the panel itself.

In addition, when the lighting device 36 is turned on under the control of the controller 13, the light emitted by the lighting device 36 may see through the panel 31 and change the color or brightness of the panel 31. At this time, under the control of the controller 13, the lighting device 36 may emit light of various colors, and the panel 31 may change to various colors to glow. In other words, in a state where the door 20' remains assembled and installed, the color or brightness of the outer appearance of the front surface of the refrigerator 1' may change, resulting in a change in the outer appearance.

In addition, the refrigerating chamber door 204 and the freezing chamber door 203 may glow in different colors as needed and may glow in a selected color in harmony with the surrounding furniture or installation environment to harmonize with the surrounding environment. Additionally, when the installation or use environment or use condition is changed, the outer appearance of the front surface of the refrigerator 1' may be freely changed accordingly.

Meanwhile, the seeing-through door 70 may also cause the panel 31 to glow in a set color according to the operation of the lighting device 36. In other words, the door 20' and the seeing-through door 70 may glow with the same color and form the entire outer appearance of the front surface of the refrigerator. At this time, the seeing-through region may become invisible.

Additionally, if the user wishes to view the space behind the seeing-through door 70 via the visualization region of the seeing-through door 70, the seeing-through light 491 may be turned on by the user's manipulation. When the see-through light 491 is turned on, the space behind the see-through door 70 becomes bright, and thus the rear of the see-through door 70 may be seen through the see-through assembly 45 and the panel assembly 30.

INDUSTRIAL APPLICABILITY

The refrigerator according to the embodiment of the present disclosure has improved industrial applicability because the outer appearance thereof may be improved and convenience of use may be improved.

The invention claimed is:

1. A home appliance comprising:

a cabinet that defines a storage space; and a door configured to open and close at least a portion of the storage space, wherein the door comprises:

a door body having an opening passing through in a front and rear direction, and a panel assembly that is mounted on the door body to cover the opening and defines a front surface of the door, the panel assembly being configured to transmit light such that the front surface of the door is expressed in a set color, and the storage space is seen through the opening, wherein the panel assembly includes:

a panel that defines a front surface of the panel assembly and is made of a material configured to transmit light, a lighting device provided behind the panel and configured to emit light to make the panel glow with the set color, a light guide plate provided at a rear of the panel and configured to guide light emitted from the lighting device to the panel, and a reflective layer provided on a rear of the light guide plate and configured to reflect light guided along the light guide plate forward, and wherein the reflective layer includes:

a first region that at least partially overlaps with the opening and is configured to allow the storage space to be seen through the opening, and a second region that is disposed along a perimeter of the first region and is more opaque than the first region to reflect more light forward.

2. The home appliance of claim 1, wherein the panel assembly includes a back cover forming a rear of the panel assembly, and wherein a cover opening is formed in the back cover to at least partially overlap the opening.

3. The home appliance of claim 1, wherein a pattern for diffusion of light is formed on the light guide plate, wherein the pattern includes:

a first pattern part configured to at least partially overlap the opening and to be capable of seeing through; and a second pattern part formed along the perimeter of the first pattern part, and wherein a transparency of the first pattern part is higher than a transparency of the second pattern part.

4. The home appliance of claim 1, wherein the panel assembly further includes a color layer disposed on the panel and configured to present a color of the panel based on the lighting device being turned off, wherein the color layer includes:

a first color part at least partially overlapping the opening; and a second color part formed around the first color part, and wherein a saturation of the first color part is higher than a saturation of the second color part.

5. The home appliance of claim 1, further comprising:

a main door configured to open and close the storage space and having a body opening communicating with the storage space, wherein the door is rotatably mounted on the main door to open and close the opening, and an inside of the body opening is seen through via the panel assembly.

6. A home appliance comprising:

a cabinet that defines a storage space; and a door configured to open and close at least a portion of the storage space, wherein the door comprises:

a door body having an opening passing through in a front and rear direction, and a panel assembly that is mounted on the door body to cover the opening and defines a front surface of the door, the panel assembly being configured to transmit light such that the front surface of the door is expressed in a set color, and the storage space is seen through the opening, wherein the panel assembly includes:

a panel that defines a front surface of the panel assembly and is made of a material configured to transmit light, and a lighting device provided behind the panel and configured to emit light to make the panel glow with the set color, wherein the door body includes:

a door liner that defines a rear of the door body, a front plate that defines a front surface of the door body, and a seeing-through assembly disposed between the door liner and the front plate to cover the opening, and made of a seeing-through material, wherein the opening is defined in the door liner, and wherein the front plate is made of a seeing-through plate-shaped material to cover a front surface of the seeing-through assembly.

7. The home appliance of claim 6, wherein the front plate includes:

a seeing-through part formed to be capable of seeing through at a position corresponding to the seeing-through assembly; and a bezel part formed along an outer perimeter of the seeing-through part and formed opaquely.

8. The home appliance of claim 6, wherein the seeing-through assembly includes:

a plurality of plates sized to cover the opening and spaced forward and backward, and a spacer formed along a perimeter of the plurality of plates to connect the plurality of plates to each other.

9. The home appliance of claim 6, wherein the door body includes an insulating material provided between the door liner, the front plate, and a perimeter of the seeing-through assembly, and wherein the panel assembly is detachably mounted on the door body provided with the insulating material.

10. The home appliance of claim 6, wherein a seeing-through light is provided at the rear of the seeing-through assembly, wherein, when the seeing-through light is turned on, a space behind the seeing-through assembly becomes bright and is visible through the panel and the seeing-through assembly, and wherein, when the seeing-through light is turned off, the space behind the seeing-through assembly becomes dark and becomes more invisible.

11. The home appliance of claim 10, wherein the seeing-through light is provided on the rear of the door body and irradiates light from an outside of the seeing-through assembly toward the seeing-through assembly.

12. The home appliance of claim 10, wherein the lighting device is turned off when the seeing-through light is turned on.

* * * * *